US012083411B2

(12) United States Patent
Cappello et al.

(10) Patent No.: US 12,083,411 B2
(45) Date of Patent: Sep. 10, 2024

(54) SKATEBOARDS WITH A MULTI-WHEEL TRUCK

(71) Applicant: KARSTEN MANUFACTURING CORPORATION, Phoenix, AZ (US)

(72) Inventors: Dylan R. Cappello, Charlotte, NC (US); John A. Solheim, Phoenix, AZ (US); Jordan D. Shoenhair, Scottsdale, AZ (US); Justin A. Paselk, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/342,660

(22) Filed: Jun. 27, 2023

(65) Prior Publication Data

US 2023/0338817 A1 Oct. 26, 2023

Related U.S. Application Data

(63) Continuation of application No. 17/362,784, filed on Jun. 29, 2021, now Pat. No. 11,684,842.

(60) Provisional application No. 63/201,491, filed on Apr. 30, 2021, provisional application No. 63/045,582, filed on Jun. 29, 2020.

(51) Int. Cl.
*A63C 17/01* (2006.01)

(52) U.S. Cl.
CPC ..... *A63C 17/015* (2013.01); *A63C 17/012* (2013.01)

(58) Field of Classification Search
CPC .... A63C 17/015; A63C 17/047; A63C 17/012
See application file for complete search history.

(56) References Cited

U.S. PATENT DOCUMENTS

| | | | |
|---|---|---|---|
| 4,062,557 | A | 12/1977 | Roden |
| 4,337,961 | A | 7/1982 | Covert |
| 4,817,974 | A | 4/1989 | Bergeron |
| 5,947,495 | A | 9/1999 | Null |
| 6,158,753 | A | 12/2000 | Sturbaum |
| 6,431,568 | B1 | 8/2002 | McCleese |
| 7,581,739 | B2 | 9/2009 | Fraley |
| 8,246,058 | B2 | 8/2012 | Wang et al. |
| 8,328,206 | B2 | 12/2012 | Williams |
| 8,608,185 | B2 | 12/2013 | Bermal |
| 8,807,577 | B2 | 8/2014 | Lai |
| 9,492,731 | B2 | 11/2016 | Marusiak et al. |
| 9,573,045 | B2 | 2/2017 | Lai |
| 9,604,124 | B2 | 3/2017 | Aders |

(Continued)

FOREIGN PATENT DOCUMENTS

| | | |
|---|---|---|
| ES | 2320189 | 5/2009 |
| FR | 2766382 | 1/1999 |

(Continued)

OTHER PUBLICATIONS

PCT International Search Report and Written Opinion dated Jun. 22, 2020 from corresponding PCT Application No. PCT/US2020/024164.

*Primary Examiner* — Brian L Swenson

(57) ABSTRACT

A multi-wheel truck that minimizes wheel interactions with discontinuous and uneven surfaces. The truck provides a suspension system that absorbs impact force caused by uneven surfaces and a unique attack angle that allows obstacles to be traversed when approached from a wide range of angles.

19 Claims, 18 Drawing Sheets

(56) References Cited

U.S. PATENT DOCUMENTS

| | | | | |
|---|---|---|---|---|
| 9,821,215 | B2 | 11/2017 | Ivazes | |
| 10,322,332 | B2 | 6/2019 | Strand | |
| 10,335,667 | B2 | 7/2019 | Almansa et al. | |
| 10,967,244 | B2 | 4/2021 | Lininger | |
| 11,684,842 | B2 * | 6/2023 | Cappello ..... | A63C 17/0073 280/87.042 |
| 2003/0141688 | A1 | 7/2003 | Lynn | |
| 2006/0006622 | A1 | 1/2006 | Gesmer | |
| 2010/0090423 | A1 | 4/2010 | Farrelly | |
| 2012/0223492 | A1 | 9/2012 | Ackerman | |
| 2013/0181417 | A1 | 7/2013 | Smith | |

FOREIGN PATENT DOCUMENTS

| | | |
|---|---|---|
| FR | 2810894 | 1/2002 |
| KR | 20050060368 | 6/2005 |
| KR | 200390293 | 7/2005 |
| WO | 1997028863 | 8/1997 |
| WO | 1998005390 | 2/1998 |
| WO | 2002020100 | 3/2002 |
| WO | 2003033089 | 4/2003 |
| WO | 2006061528 | 6/2006 |
| WO | 2014133485 | 9/2014 |
| WO | 2015066749 | 5/2015 |

* cited by examiner

SKATEBOARDS WITH A MULTI-WHEEL TRUCK

RELATED APPLICATION DATA

This application is a continuation of U.S. patent application Ser. No. 17/362,784 filed on Jun. 29, 2021, which claims the benefit of U.S. Patent Application Ser. No. 63/045,582, filed on Jun. 29, 2020, and U.S. Patent Application Ser. No. 63/201,491, filed on Apr. 30, 2021, the contents of all of which are entirely incorporated herein by reference.

TECHNICAL FIELD

This disclosure relates generally to skateboards and more particularly to a multi-wheel skateboard truck.

BACKGROUND

Individuals ride and use skateboards as a convenient and entertaining form of transportation. Generally, skateboards (or electrically powered versions thereof) present many favorable advantages over other self-propelled transportation alternatives, as skateboards can be easily stored, picked up, and carried. However, and quite often, when users ride skateboards over discontinuous or uneven surfaces including (but not an exhaustive list of) cracks, contraction joints, expansion joints, control joints, and bumps, the impact between the wheels and the discontinuous surface applies an undesirable force to skateboard. This impact force results in detrimental effects including, noise, shock to the rider, loss of speed, and loss of control of the skateboard, including flipping and crashing. There is a need in the art for a moving wheel platform that minimizes wheel interactions with non-continuous and uneven surfaces to enhance an individual's riding experience and satisfaction.

DETAILED DESCRIPTION

I. Essence of the Invention

Figure 1:
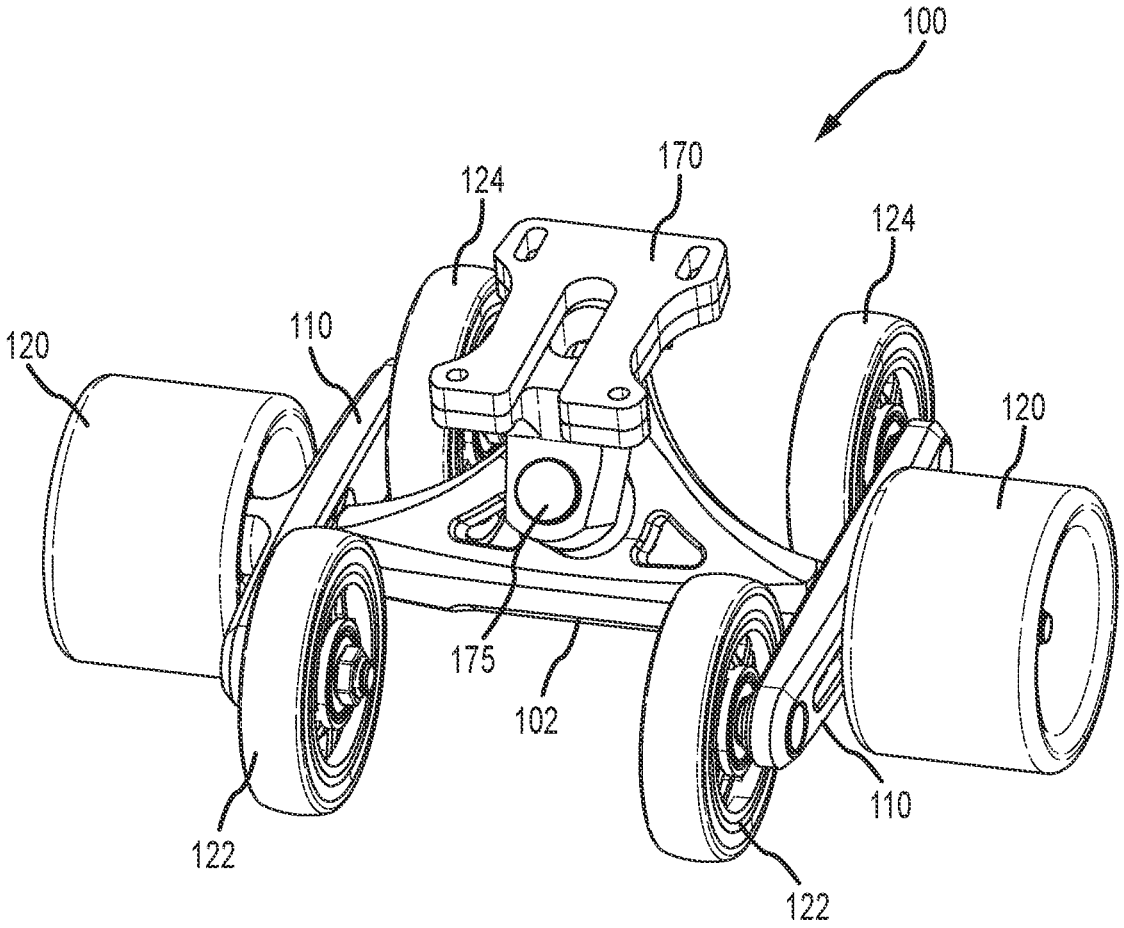
FIG. 1 illustrates a perspective view of a multi-wheel skateboard truck according to one embodiment.

Described herein is a multi-wheel skateboard truck configured to smoothly traverse discontinuous surfaces of various shapes and sizes at various speeds and over a wide range of directions. Presented below are multi-wheel skateboard embodiments having trucks that provide a unique suspension mechanism and unique arrangements of auxiliary wheels and central wheels to provide a unique attack angle over discontinuous surfaces. The unique suspension system and attack angle of the truck wheels combine to minimize shock associated with interactions between the wheels and obstacles or discontinuous surfaces. The suspension system comprises a plurality of wheel sets wherein each wheel set comprises a central wheel, a plurality of auxiliary wheels, and a rotatable level arm connecting the wheels. The auxiliary wheels are affixed to a front and rear region 116 of the rotatable level arm and are configured to move up and down as the level arm rotates in response to obstacles. In many embodiments, the suspension system further comprises a spring mechanism 130 configured to govern the rotation of the level arm. The attack angle of the truck is formed by the configuration of the wheels in each wheel set. Specifically, the attack angle is dependent on the auxiliary wheel spatial arrangement in relation to the central wheel. The wheel spatial arrangement and attack angle allow the truck to smoothly traverse obstacles when approaching such obstacles from a wide range of directions.

The multi-wheel truck can be used in a variety of applications besides skateboards. For example, in some embodiments, the truck can be used in wheelbarrows, industrial carts, industrial dollies, commercial carts, commercial dollies, hand trucks, stack trucks, skateboard trucks, longboard trucks, electric skateboard trucks, carriages, strollers and/or luggage. Alternatively, the apparatus, methods, and articles of manufactures described herein may be applicable to other types of applications that are in need of a truck or other moving-wheel platform that glides, hoovers, and/or maneuvers over obstacles or foreign objects (i.e. rocks, pebbles, cracks, and/or sidewalk contraction joints).

The term or phrase "connect", "connected", "connects", "connecting" used herein can be defined as joining two or more elements together, mechanically or otherwise. Connecting (whether mechanical or otherwise) can be for any length of time, e.g. permanent or semi-permanent or only for an instant.

The term or phrase "link", "linked", "links", "linking" used herein can be defined as a relationship between two or more elements where at least one element affects another element. Linking (whether mechanical or otherwise) can be for any length of time, e.g. permanent or semi-permanent or only for an instant.

The term or phrase "secure", "secured", "secures", "securing" used herein can be defined as fixing or fastening (one or more elements) firmly so that it cannot be moved or become loose. Securing (whether mechanical or otherwise) can be for any length of time, e.g. permanent or semi-permanent or only for an instant.

The term or phrase "couple", "coupled", "couples", and "coupling" used herein can be defined as connecting two or more elements, mechanically or otherwise. Coupling (whether mechanical or otherwise) can be for any length of time, e.g. permanent or semi-permanent or only for an instant. Mechanical coupling and the like should be broadly understood and include mechanical coupling of all types. The absence of the word "removably," "removable," and the like near the word "coupled," and the like does not mean that the coupling in question is or is not removable.

The term or phrase "skateboard" used herein can be defined as a ridable apparatus. The skateboard can be defined by four distinct portions. A top portion of the skateboard is defined as the portion of a deck the user stands on. A bottom portion of the skateboard is defined as the portion opposite the top portion. A stance of the right footed user by convention is defined as the left foot being forward of the right foot. A front portion of the skateboard is defined as being proximal to the left foot of the user. A back portion of the skateboard is defined as being proximal with the right foot of the user. A forward direction is defined as the skateboard direction of travel when the right foot pushes backwards on a ground surface to make the skateboard move in the opposite direction. Similarly, when the multi-wheel truck of the present invention is attached to the deck of said skateboard, a front portion of the multi-wheel truck can be defined as the portion of the truck disposed nearest the front portion of the skateboard, and a back portion of the truck can be defined as the portion of the truck disposed nearest the back portion of the skateboard.

The term or phrase "ground" or "rolling surface" used herein can be defined as the surface on which the wheels of the skateboard typically roll. The ground or rolling surface is considered to be a generally smooth surface during typical operation of the skateboard. However, at certain locations, the ground or rolling surface can comprise discontinuities or obstacles such as cracks, bumps, expansion joints, or foreign objects that create a portion of the ground or rolling surface that is unsmooth.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items to a particular order or sequence.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or ±10.0% of the related value(s), range(s) of values, relationship(s), parameter(s), or condition(s), as applicable.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
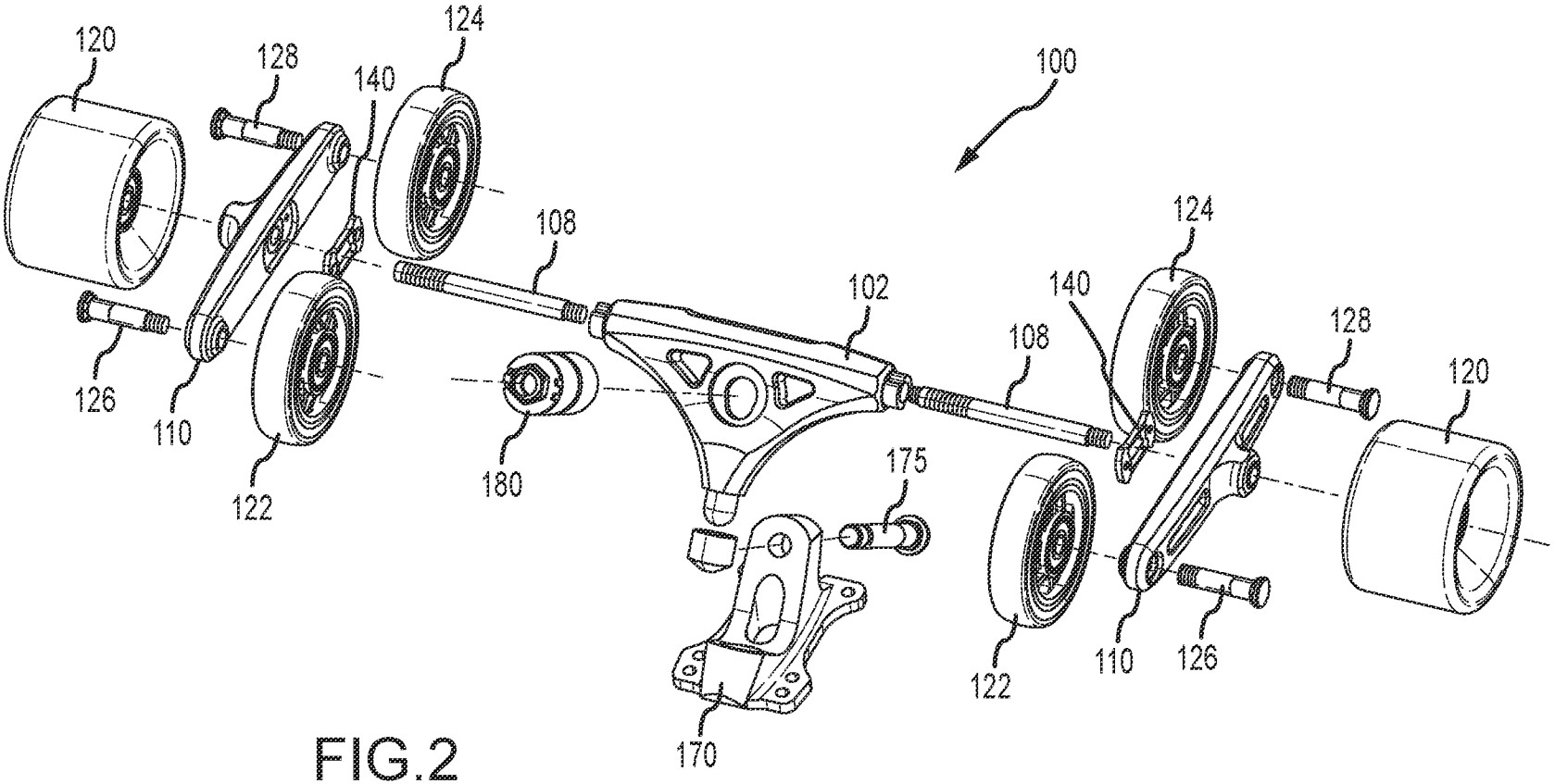
FIG. 2 illustrates an exploded view of the truck of FIG. 1.

Described below, are embodiments of a multi-wheel truck. FIGS. 1-2 illustrate an embodiment of the truck 100 that comprises a unique suspension system and attack angle $\alpha$ that allow the truck 100 to smoothly pass over discontinuous surfaces. In general, the truck 100 comprises a plurality of wheel sets comprising a rotating level arm 110 and a plurality of wheels. The truck 100 further comprises a hanger 102 that serves to connect the plurality of wheel sets. The truck 100 further comprises a baseplate 170 configured to receive the hanger 102 and couple the truck 100 to the underside of a skateboard deck (not shown). The arrangement of the hanger 102 and baseplate 170 will be described in greater detail below.

II. Suspension System

Figure 3:
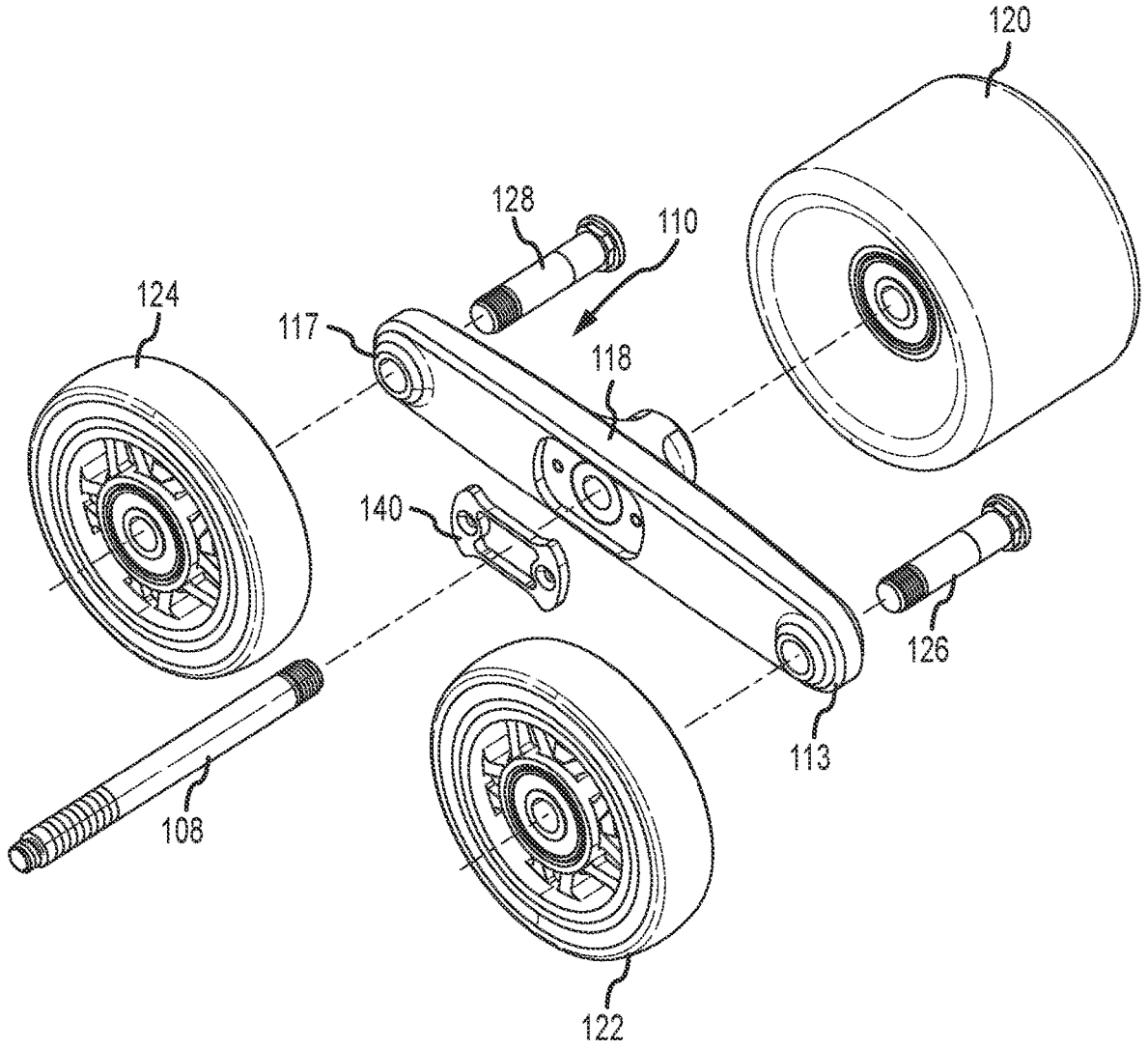
FIG. 3 illustrates an exploded view of a wheel set of the truck of FIG. 1.

The plurality of wheel sets creates a suspension system that absorbs unwanted shock upon impact with an obstacle and provides a smooth ride over such obstacles. FIG. 3 illustrates a wheel set according to the present truck 100. In many embodiments, each wheel set comprises a rotatable level arm 110 coupled to a central axle 108, at least one central wheel 120 rotatably coupled to a central axle 108, and a plurality of auxiliary wheels coupled to the level arm 110 by a plurality of auxiliary axles. In many embodiments, each wheel set comprises one central wheel 120 and two auxiliary wheels, including a leading wheel 122 and a trailing wheel 124. In many embodiments, the truck 100 comprises a pair of wheel sets, one on either side of the truck 100 and affixed to opposite ends of the hanger 102. In many embodiments, each of the pair of wheel sets is affixed to either end of the hanger 102 and sits along a longitudinal axis 1000 extending from a first end 104 of the hanger 102 to a second end 106 of the hanger 102.

The central axle 108 can be coupled to one end of the hanger 102 and configured to affix both the central wheel 120 and the rotatable level arm 110 thereto. The central axle 108 can be received by a void 156 formed within the end of the hanger 102 and fixedly coupled therein. In many embodiments, the central wheel 120 forms a bore. The bore is sized to allow the central wheel 120 to couple to and freely rotate about the central axle 108. This allows the skateboard to smoothly and securely roll along the central wheel 120 during use.

The level arm 110 is also rotatably coupled to the central axle 108. The level arm 110 comprises a front region 112 disposed near the front of the truck 100 (i.e. the portion of the truck 100 nearest the front of the skateboard), a middle region 114 centered about the central axle 108, and a rear region 116 opposite the front region 112 and disposed near the back of the truck 100. The middle region 114 comprises a middle bore 115 located substantially at the center of the level arm 110 and configured to concentrically link, attach, and/or couple the central axle 108. The middle bore 115 allows the level arm 110 to couple to and rotate about the central axle 108. In the illustrated embodiment, auxiliary wheels are attached at either end of the level arm 110 by a plurality of auxiliary axles 126, 128. As illustrated in FIG. 3, the front region 112 is configured to receive a leading wheel 122. The front region 112 comprises a front bore 113 configured to concentrically link, attach, and/or couple a front auxiliary axle 126 (hereafter "front axle"). The front axle 126 is fixedly coupled within the front bore 113 so that the front axle 126 is restricted from rotating with respect to the level arm 110. The leading wheel 122 is configured to affix to the front axle 126 and allowed to freely rotate upon said front axle 126. As shown in FIG. 3, the rear region 116 is configured to receive a trailing wheel 124. The rear region 116 comprises a rear bore 117 configured to concentrically link, attach, and/or couple a rear auxiliary axle 128 (hereafter "rear axle"). The rear axle 128 is fixedly coupled within the rear bore 117 so that the rear axle 128 is restricted from rotating with respect to the level arm 110. The trailing wheel 124 is configured to affix to the rear axle 128 and allowed to freely rotate upon said rear axle 128. The configuration of the leading and trailing wheels 122, 124 attached to either end of the level arm 110 by the plurality of auxiliary axles 126, 128 allows the leading and trailing wheels 122, 124 to roll freely along the ground during use of the skateboard. The location of the auxiliary axles 126, 128 to which the leading and trailing wheels 122, 124 are attached allows the leading and trailing wheels 122, 124 to move up or down as the level arm 110 rotates about the central axle 108.

The suspension system creates a "lifting effect" that provides smooth passage of the truck 100 over obstacles or discontinuities in the rolling surface. As the truck 100 rolls along the ground, the level arm 110 can rotate in response to discontinuities in the surface. The rotation of the level arm 110 allows the auxiliary wheels on either end of the level arm 110 to raise or lower according to the terrain of the rolling surface. The freedom of the auxiliary wheels to raise or lower in response to obstacles serves to absorb the shock typically associated with impact between a wheel and such obstacles.

The lifting effect also serves to dynamically distribute load between the central and auxiliary wheels during use to provide an even smoother ride. During normal use of the skateboard rolling along a smooth surface, the central wheel 120 can support a majority of the weight of the rider. However, when the central wheel 120 encounters an obstacle, such as a crack, the leading wheel 122 and/or the trailing wheel 124 can bear the majority of the weight of the rider to keep the truck 100 stable. For example, upon impact with a crack in the rolling surface, the leading wheel 122 encounters the crack first. As the leading wheel 122 is in the crack, the level arm 110 can rotate to lower the leading wheel 122 into the crack. Meanwhile, the majority of the load of the skateboard is supported by the central wheel 120, which continues to roll along the main rolling surface. As the leading wheel 122 exits the crack, the central wheel 120 can enter the crack. The level arm 110 can rotate to raise the leading wheel 122 and allow it to continue rolling along the main rolling surface. Rather than falling into the crack and causing deceleration of the board or shock to the rider, the central wheel 120 can be suspended over the crack by the level arm 110. Because the level arm is supported on either end by the leading and trailing wheels 122, 124, which are rolling on the smooth rolling surface, substantially the entire load of the skateboard is supported between the auxiliary wheels, and little to none of the load is carried by the central wheel 120. As the central wheel 120 exits the crack, the trailing wheel 124 can enter the crack. As the trailing wheel 124 is in the crack, the level arm 110 can rotate to lower the trailing wheel into the crack. Meanwhile, the majority of the load of the board is supported by the central wheel 120, which is again rolling along the main rolling surface. Because there is at least one wheel rolling along the main rolling surface and supporting the majority of the weight of the rider at any given time, the suspension system provides stability to the truck 100 by allowing the wheel set to act as a single wheel rolling continuously along a smooth surface.

III. Attack Angle

The truck 100 further comprises a spatial arrangement between the plurality of wheels that works in conjunction with the suspension system to provide smooth traversal of obstacles and discontinuous surfaces. The spatial arrangement of the wheels enables the lifting effect of the suspension system to occur no matter the angle at which the skateboard encounters an obstacle. In many embodiments, the central and auxiliary wheels are spaced apart, both laterally (i.e. with respect to a direction extending along the longitudinal axis 1000) and in a front-to-rear direction. This spatial arrangement of the wheels provides the truck 100 with a wide base and prevents the wheels within each given wheel set from all impacting an obstacle simultaneously. Therefore, there is always at least one wheel of every given wheel set supporting the weight of the rider on the main rolling surface at any given time. The spatial relationship between the wheels within a given wheel set can be characterized by an attack angle α, described in detail below.

Figure 4:
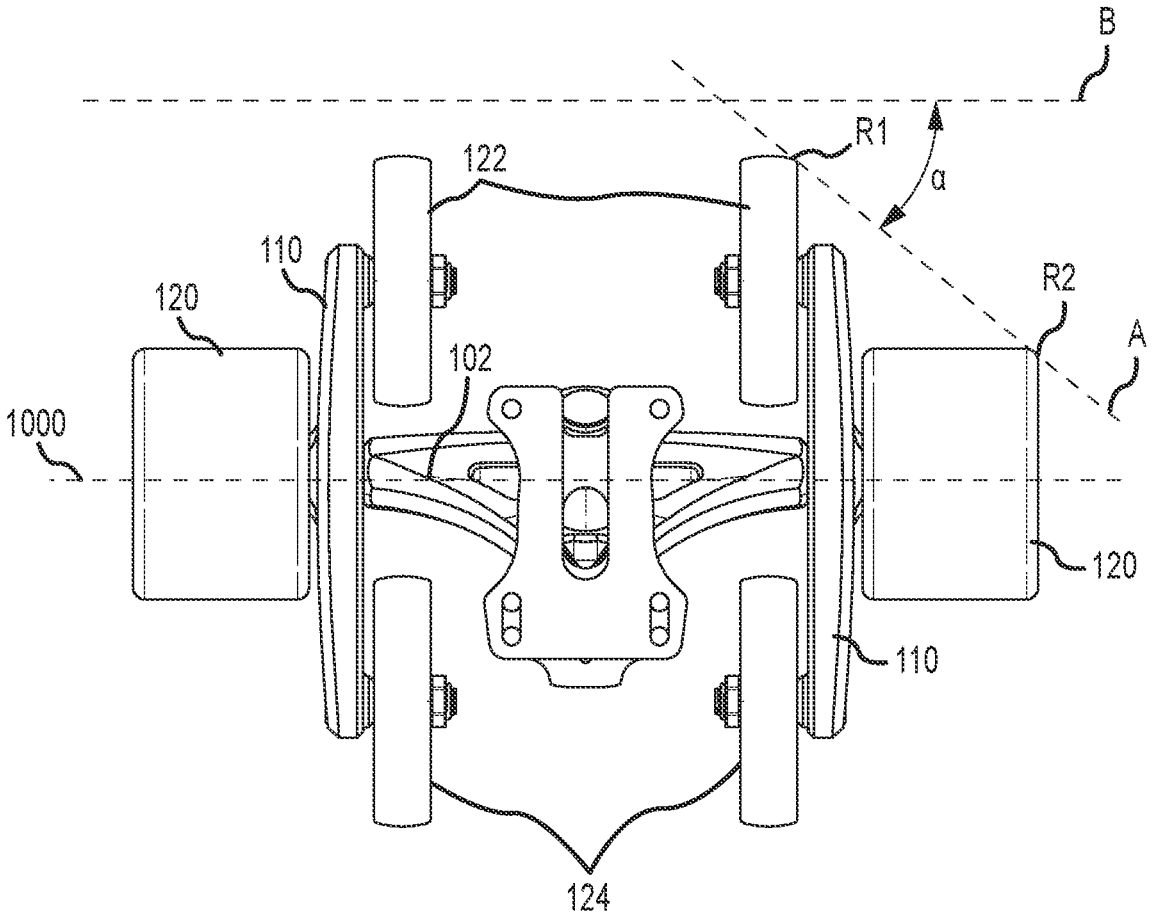
FIG. 4 illustrates a top view of the truck of FIG. 1 forming an attack angle according to the present invention.

The attack angle α is a characteristic of the spatial relationship between the central and auxiliary wheels of the truck 100. As shown in FIG. 4, the attack angle α can be defined as the acute angle between a first reference line A connecting the central wheel 120 and the leading wheel 122 of a particular wheel set and a second reference line B extending parallel to the longitudinal axis 1000. The first reference line A can connect a first reference point R1 located on the leading wheel 122 and a second reference point R2 located on the central wheel 120. The first reference point R1 is the forwardmost and outermost (i.e. furthest spaced away from the hanger 102) point of the leading wheel 122. Similarly, the second reference point R2 is the forwardmost and outermost point of the central wheel 120. Different configurations of the leading and central wheel 120 can alter the relationship between the first and second reference point R1, R2, thus altering the directionality of the first reference line A.

Because the attack angle α relates the position of the first and second reference points R1, R2, the attack angle α is dependent on the size and location of the central wheel 120 and the leading wheel 122. Specifically, different specific configurations of the central wheel 120 and the leading wheel 122 in terms of the lateral spacing between the central wheel 120 and leading wheel 122, the front-to-rear spacing between the central wheel 120 and leading wheel 122, the widths of the central wheel 120 and leading wheel 122, and the diameters of the central wheel 120 and leading wheel 122 create different attack angles α. In this way, the attack angle α can be manipulated by changing the spatial relationship between the leading and central wheels 120 and/or by altering the diameter and/or width of the leading wheel 122 and central wheel 120. For example, providing a greater lateral distance between the leading wheel 122 and the central wheel 120 creates an attack angle α that is shallower, while providing a smaller lateral distance between the leading wheel 122 and the central wheel 120 creates an attack angle α that is steeper. Similarly, altering the diameter and/or width of one or more wheels within the wheel set changes the location of the first reference point R1 and/or second reference point R2, which in turn alters the orientation of the first reference line A. The diameter and width of the plurality of wheels is further detailed below.

Figure 5:
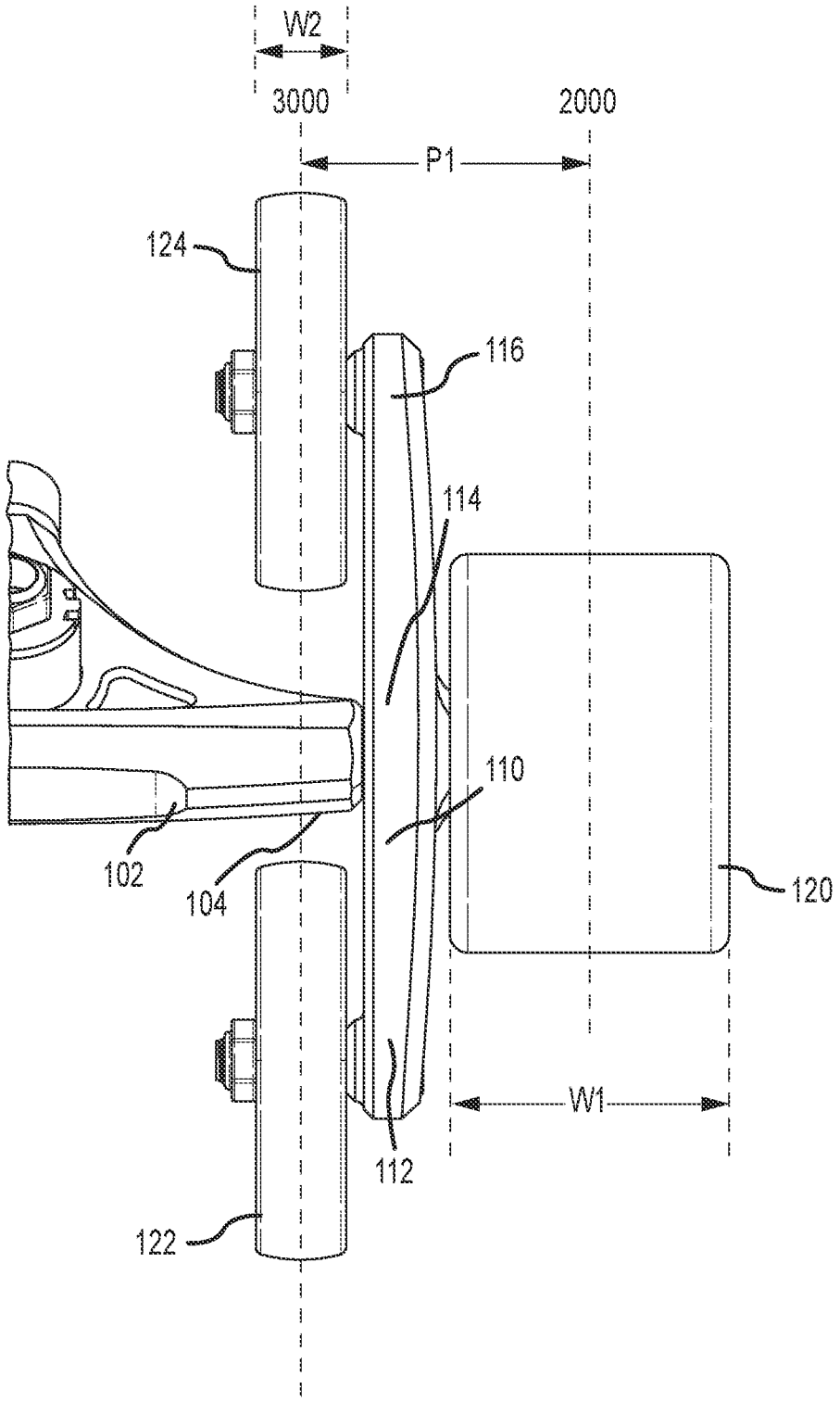
FIG. 5 illustrates the dimensions and spacing of the wheel set illustrated in FIG. 3 from a top view.

In many embodiments the central wheel 120 is laterally spaced away from the plurality of auxiliary wheels to create the attack angle α. In general, the plurality of auxiliary wheels comprise an "inline" configuration in which the leading and trailing wheels 122, 124 are positioned in a straight line from the front of the truck 100 to the rear. The central wheel 120 is not in line with respect to the auxiliary wheels, but rather is laterally spaced away from the auxiliary wheels. In many embodiments, as illustrated by FIG. 5, the central wheel 120 is laterally spaced further from the hanger 102 than the auxiliary wheels, such that the auxiliary wheels are located between the central wheel 120 and the hanger 102. In alternative embodiments (not shown), the central wheel 120 can be laterally spaced closer to the hanger 102 than the auxiliary wheels, such that the central wheel 120 is located between the auxiliary wheels and the hanger 102. The lateral spacing between the auxiliary wheels, in particular the leading wheel 122 and the central wheel 120, with respect to one another can be characterized by the distance between a pair of planes. The leading wheel 122 and central wheel 120 can each sit upon a respective plane separated by a particular distance in a longitudinal direction. FIG. 5 illustrates a first plane 2000 extending in a front-to-rear direction through the center of the central wheel 120. Similarly, a second plane 3000 is illustrated, wherein the second plane 3000 extends in a front-to-rear direction (thus parallel to the first plane 2000) through the center of the leading wheel 122. In many embodiments, the distance P1 between the first plane 2000 and the second plane 3000 is approximately 2.0 inches. In some embodiments, the distance P1 between the first plane 2000 and the second plane 3000 can range approximately between 0.5 inches and 3.0 inches. In some embodiments, the distance P1 between the first plane 2000 and the second plane 3000 ranges approximately between 0.5 inches and 1.0 inches, approximately between 1.0 inches and 1.5 inches, approximately between 1.5 inches and 2.0 inches, between approximately 2.0 inches and 2.5 inches, or approximately between 2.5 inches and 3.0 inches. The distance between plane 2000 and plane 3000 create a wheel set in which the central wheel 120 is laterally spaced from the auxiliary wheels. This configuration creates the desired attack angle α and a wide base for the wheel set.

Figure 6:
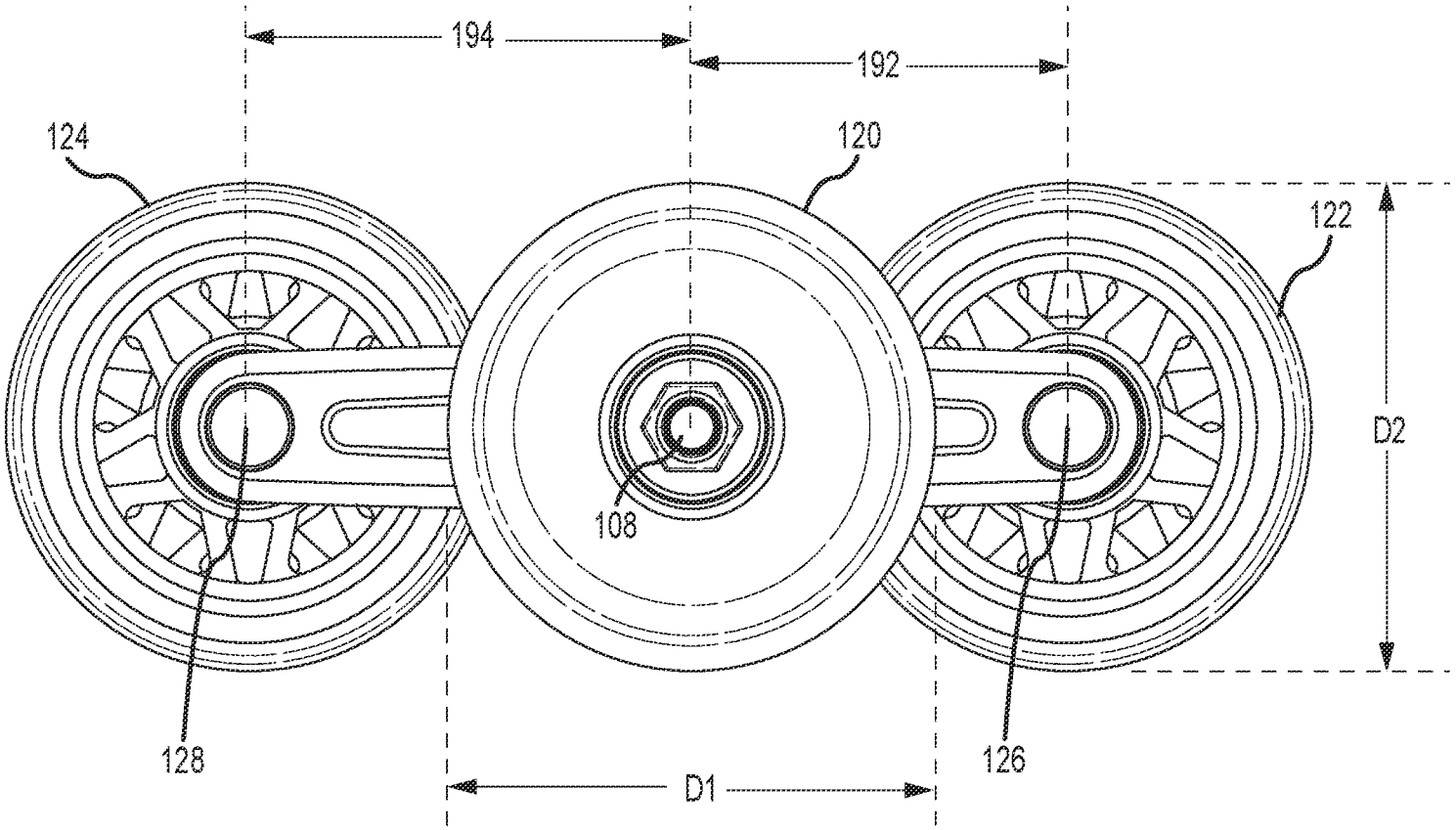
FIG. 6 illustrates the dimensions and spacing of the wheel set illustrated in FIG. 3 from a side view.

The attack angle α is further determined by a front-to-rear distance between adjacent wheels. FIG. 6 illustrates a front-to-rear distance defined 192 between the leading wheel 122 and the central wheel 120, wherein the distance 192 is measured as the perpendicular distance between the axles (i.e. the front axle 126 and the central axle 108) upon which each wheel is attached. Similarly, a front-to-rear distance 194 between the central wheel 120 and the trailing wheel 124 can be measured as the perpendicular distance between the central axle 108 and the rear axle 128, upon which each respective wheel is attached. In many embodiments, the front-to-rear distance 192, 194 between adjacent wheels is dependent on the front-to-rear length of the level arm 110, as the leading and trailing wheels 122, 124 are affixed proximate either end of the level arm 110.

In many embodiments, the front-to-rear distance between any adjacent pair of wheels can be approximately 1.5 inches. In some embodiments, the front-to-rear distance between any adjacent pair of wheels can be between approximately 0.5 and 2.5 inches. In some embodiments, the front-to-rear distance between adjacent wheels can be between 0.5 and 1.0 inches, between 1.0 and 1.5 inches, between 1.5 and 2.0 inches, or between 2.0 and 2.5 inches. In some embodiments, the front-to-rear distance between adjacent wheels can be between 0.5 and 0.75 inches, between 0.75 and 1.0 inches, between 1.0 and 1.25 inches, between 1.25 and 1.5 inches, between 1.5 and 1.75 inches, between 1.75 and 2.0 inches, between 2.0 and 2.25 inches, or between 2.25 and 2.5 inches. In many embodiments, the front-to-rear distance 192 between the leading wheel 122 and the central wheel 120 can be substantially similar to the front-to-rear distance 194 between the central wheel 120 and the trailing wheel 124. In other embodiments, the front-to-rear distance 192 between the leading wheel 122 and the central wheel 120 can substantially differ from the front-to-rear distance 194 between the central wheel 120 and the trailing wheel 124. The front-to-rear distance between adjacent wheels determines, in part, the location of the first reference point R1 and the second reference point R2, and therefore influences the attack angle α.

The configuration of the central wheel 120 and the leading wheel 122, both in terms of spacing and dimensions of each wheel, define the attack angle α for the truck 100. In many embodiments, an attack angle α between 30 and 60 degrees is desirable to allow the truck 100 the ability to smoothly traverse obstacles at the widest range of angles. In many embodiments, the attack angle α of the present truck 100 is approximately 45 degrees. In some embodiments, the attack angle α is between approximately 30 degrees and 60 degrees. In some embodiments, the attack angle α is between approximately 30 and 35 degrees, between approximately 35 and 40 degrees, between approximately 40 degrees and 45 degrees, between approximately 45 degrees and 50 degrees, between approximately 50 degrees and 55 degrees, or between approximately 55 degrees and 60 degrees. In other embodiments, the attack angle α is between approximately 30 and 32 degrees, between approximately 32 and 34 degrees, between approximately 34 and 36 degrees, between approximately 36 and 38 degrees, between approximately 38 and 40 degrees, between approximately 40 degrees and 42 degrees, between approximately 42 degrees and 44 degrees, between approximately 44 degrees and 46 degrees, between approximately 46 degrees and 48 degrees, between approximately 48 degrees and 50 degrees, between approximately 50 degrees and 52 degrees, between approximately 52 degrees and 54 degrees, between approximately 54 degrees and 56 degrees, between approximately 56 degrees and 58 degrees, or between approximately 58 degrees and 60 degrees.

Figure 7:
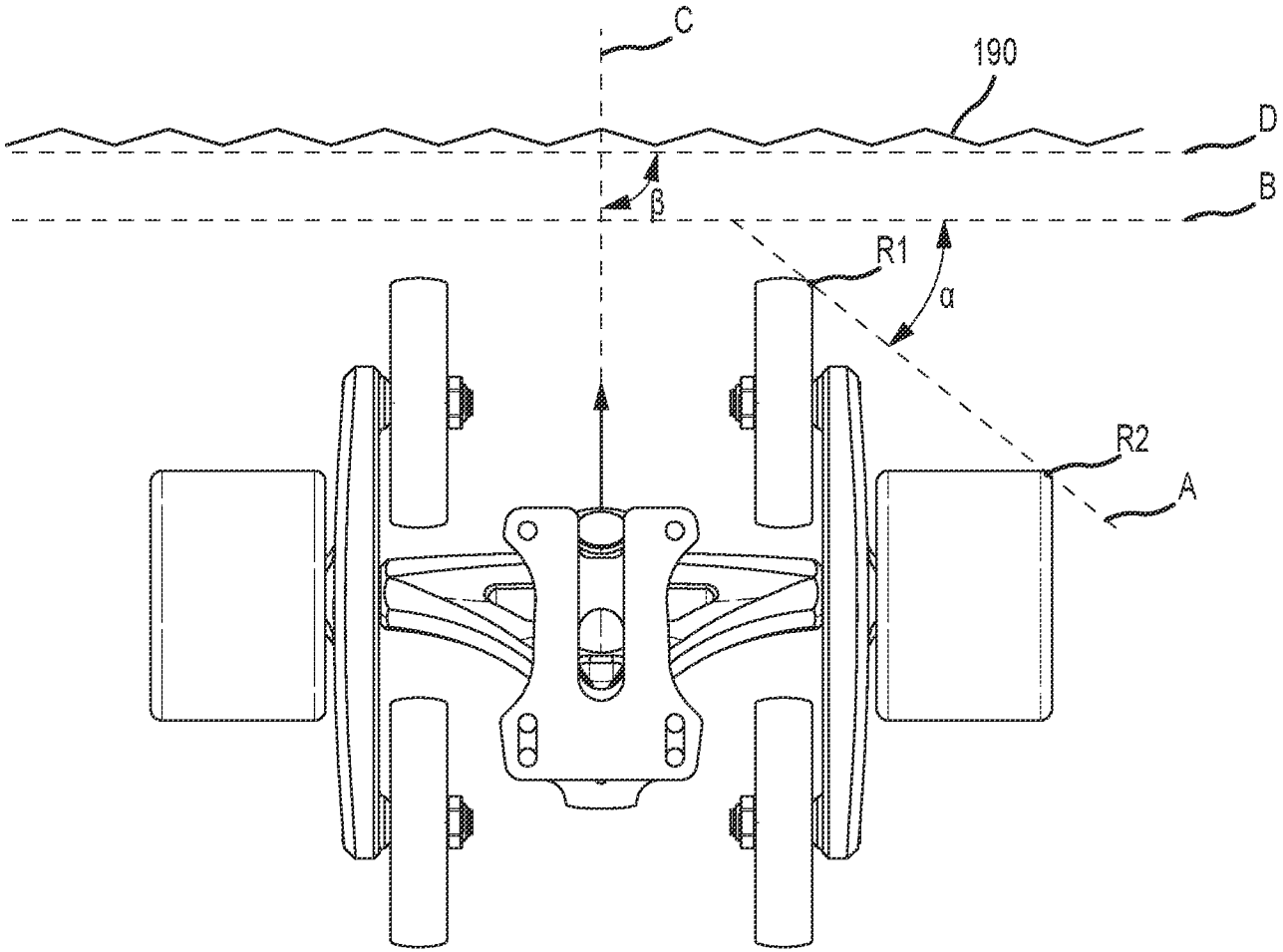
FIG. 7 illustrates a top view of a multi-wheel truck according to one embodiment comprising an attack angle approaching an obstacle at a particular approach angle.
Figure 8:
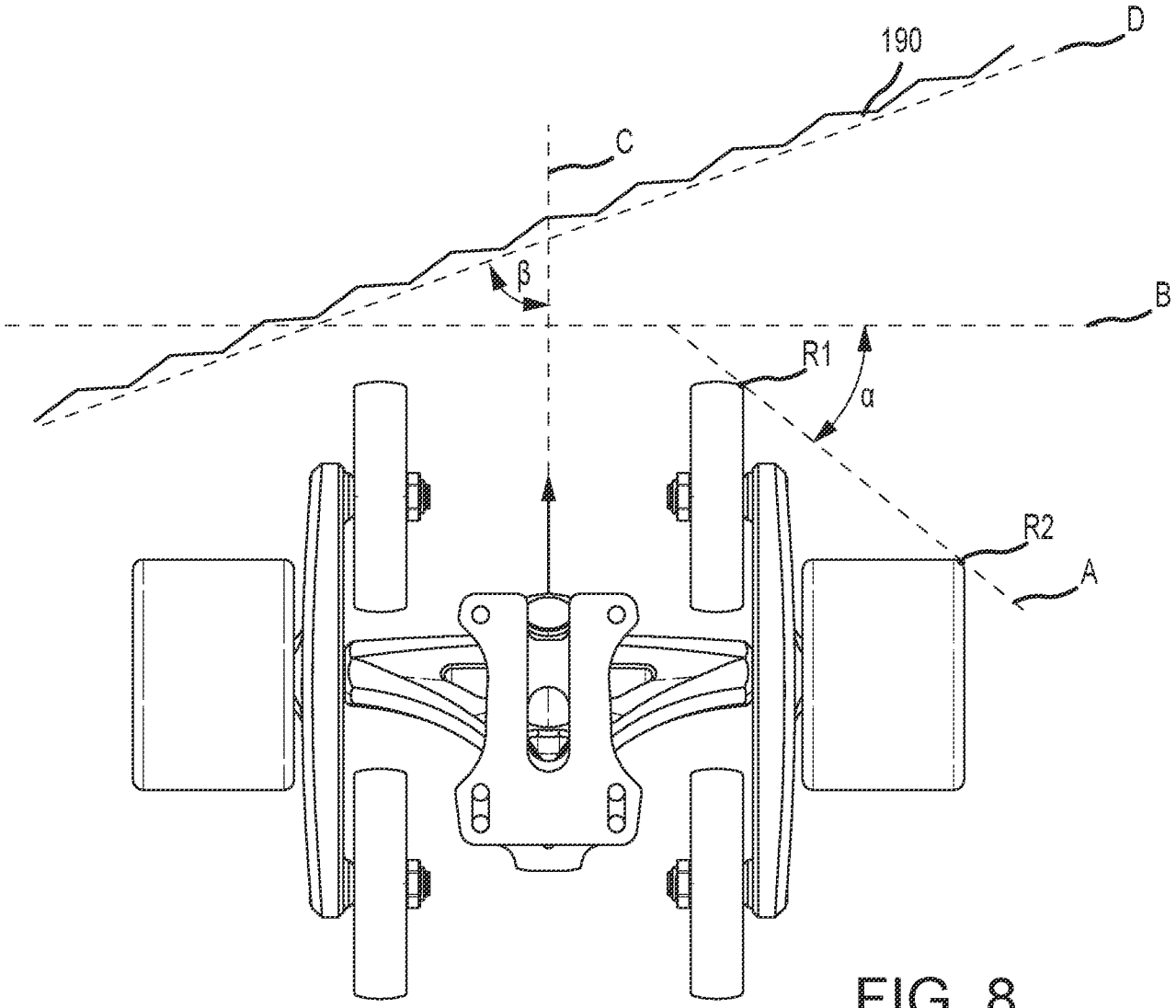
FIG. 8 illustrates a top view of the multi-wheel truck of FIG. 7 approaching an obstacle at an alternative approach angle.

An optimized attack angle α enhances the ability of the truck 100 to smoothly traverse obstacles of varying size, while approaching such obstacles at a wide range of angles. As shown in FIGS. 7 and 8, an approach angle β can be defined between the truck 100 and an obstacle 190 as the skateboard approaches the obstacle 190. The approach angle β can be defined as the acute angle between the obstacle 190 and the skateboard's direction of travel. More specifically, the approach angle β is formed by a reference line C corresponding to the direction of travel at the moment the truck 100 impacts the obstacle 190 and a second reference line D tangent to the obstacle 190 at the point of impact. For example, a skateboard approaching an elongate obstacle 190 "straight on" would define an approach angle β of approximately 90 degrees, while a skateboard approaching the obstacle 190 from any direction other than straight on would define an approach angle β substantially less than 90 degrees.

The attack angle α of the truck 100 allows the truck 100 to smoothly traverse obstacles and discontinuous surfaces at a wider range of approach angles R than a conventional skateboard. Because the central wheel 120 and the leading wheel 122 are laterally spaced apart to form the attack angle α, the truck 100 essentially comprises a wider base than a similar board with an in-line wheel configuration or a conventional skateboard forming no angle of attack. The angle of attack reduces the likelihood that multiple wheels in the set will impact an obstacle at the same time. This provides balance and stability over obstacles of various sizes and orientations by allowing at least one wheel in each wheel set to contact the regular rolling surface at any given time. In other words, the attack angle α allows the lifting effect to occur at a wide range of approach angles β.

When the present truck 100 encounters an obstacle at any approach angle β, the load created by the weight of the rider can be shifted between the central and auxiliary wheels in both a front-to-rear direction as well as a lateral direction. This configuration provides the present truck 100 with two more degrees of stability than a conventional skateboard truck, which comprises only a single wheel on either side of a truck 100. When a conventional truck encounters an obstacle, the load created by the weight of the rider cannot be shifted from the wheel, and thus the wheel experiences the full force of impact with the obstacle. In contrast, the ability to shift load between a central wheel 120 and auxiliary wheels allows the present truck 100 to absorb the force of impact with the obstacle. The ability to shift load in multiple directions due to the attack angle α of the truck 100 provides a greater absorption of this force over a wider range of approach angles β.

Figure 9:
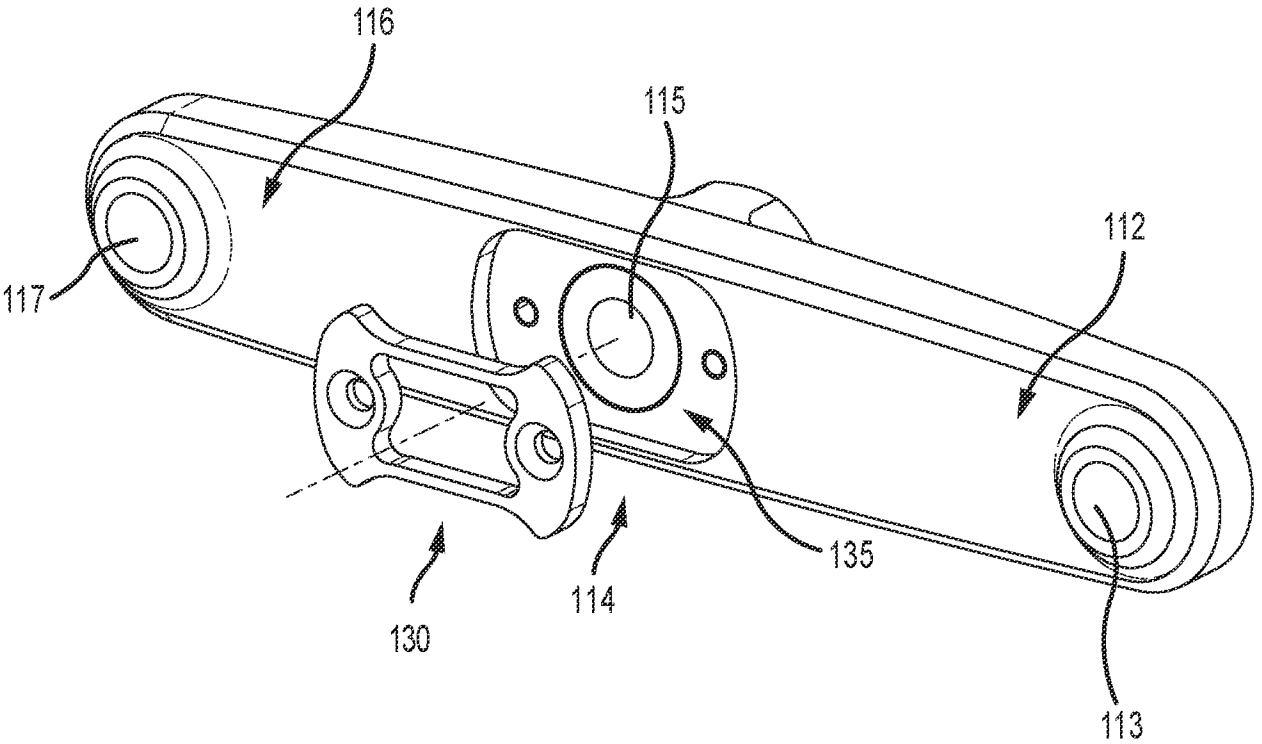
FIG. 9 illustrates an exploded view of a level arm and corresponding spring insert according to the embodiment of FIG. 1.
Figure 10:
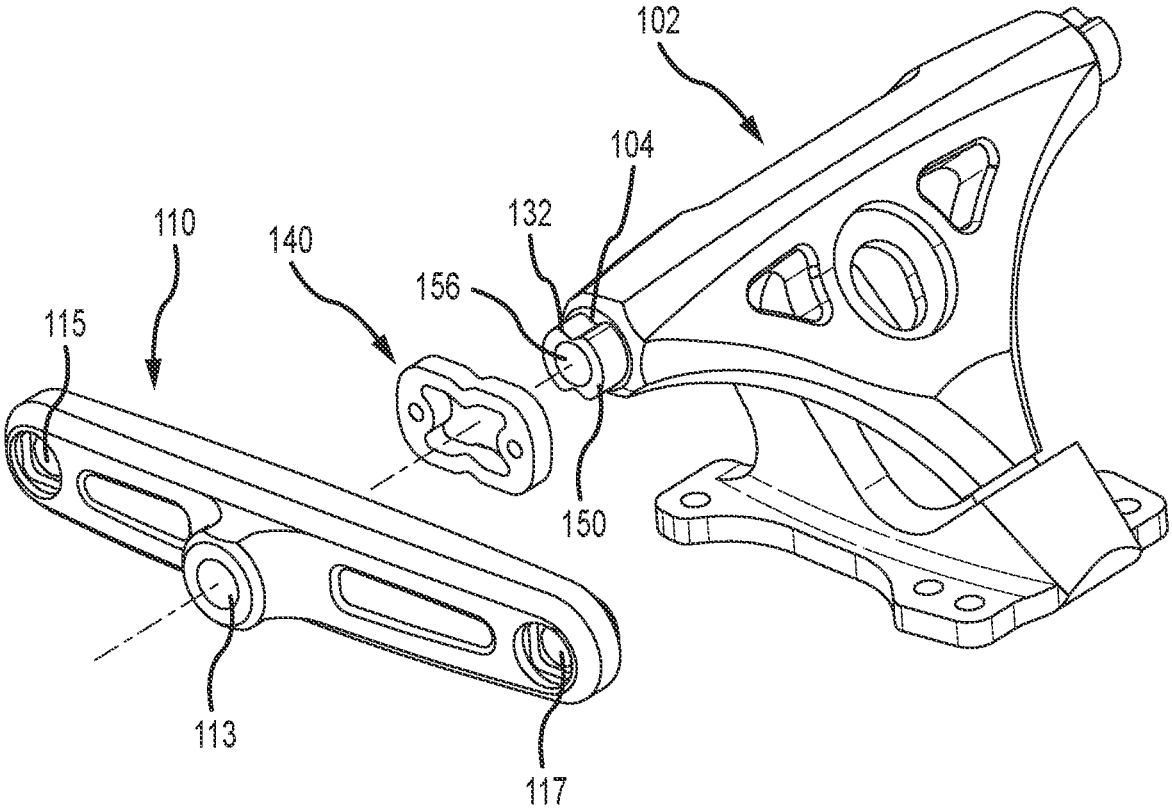
FIG. 10 illustrates an exploded view of the level arm, spring insert, and hanger of the truck of FIG. 1.

The lifting effect allows the truck 100 to smoothly traverse obstacles due to the lifting of the leading wheel 122 and the trailing wheel 124 upon the level arm 110 rotating about the central axle 108. However, in some situations, such as when the skateboard is being carried rather than ridden, it may be desirable for the rotation of the level arm 110 to be selectively restricted. Doing so can prevent the level arm 110 from freely swinging back and forth while the skateboard is being carried, which can lead to the wheels slamming against the underside of the skateboard. Referring now to FIGS. 9-10, the level arm 110 may comprise a spring mechanism 130 that provides a certain amount of mechanical interference to control the rotation of the level arm 110 about the axle. In many embodiments, the spring mechanism 130 can comprise an insert recess 132 formed within level arm 110 and configured to receive a spring insert 140. The spring insert 140 can be configured to engage and work in conjunction with one or more components of the truck 100 to create a "spring effect" that provides resistance against rotation of the level arm 110 under certain loads. The insert recess 132 can be formed within the middle region 114 of the level arm 110 and can be centered about the middle bore 115 of the level arm 110. In this way, the middle bore 115 can extend through a portion of the insert recess 132 and the central axle 108 can extend through the entirety of the insert recess 132. Preferably, the insert recess 132 is formed inward from an inward facing surface of the level arm 110 (i.e. the side of the level arm 110 that faces toward the hanger 102 when the level arm 110 is affixed to the central axle 108). The location and orientation of the spring insert 140 is provided to expose the corresponding spring insert 140 toward an end of the hanger 102, the geometry of which the spring insert 140 will engage to produce the desired spring effect.

The insert recess 132 can receive a spring insert 140 that is configured to create a spring effect that governs the rotation of the level arm 110 about the axle. The spring insert 140 can be secured within the recess by the use of mechanical fasteners such as screws or snap fit mechanisms, by the use of adhesives, or by a combination thereof. The spring insert 140 is designed to provide a certain amount of resistance against the rotation of the level arm 110 to retain the position of the level arm 110 as the skateboard is being carried. Retaining the position of the level arm 110 as the skateboard is carried through the air protects the skateboard by preventing the auxiliary wheels from slamming against the skateboard deck. The spring insert 140 can be configured to restrict rotation of the level arm 110 under relatively light loads while permitting rotation of the level arm 110 under relatively heavy loads. For instance, the spring insert 140 can restrict rotation of the level arm 110 under light loads typically associated with a user carrying the skateboard rather than riding it. The spring insert 140 can also permit rotation of the level arm 110 under heavy loads experienced when the skateboard is ridden over an obstacle.

In many embodiments, as shown in FIGS. 9 and 10, the spring insert 140 is a single, substantially flat piece and is configured to correspond to the shape of the insert recess 132 such that the spring insert 140 sits flush within the insert recess 132. The spring insert 140 can be formed of a generally flexible material such as an injection-molded plastic. The spring insert 140 can be constructed from any one or combination of the following: nylon, polypropylene, polyethylene, thermoplastic resins, thermoplastic polyurethane, thermosetting resins, aromatic diisocyanates, toluene diisocyanate (TDI), methylene diphenyl diisocyanate (MDI), acrylonitrile butadiene styrene (ABS), acetal, steel, steel alloy, or any material suitable for providing a spring insert 140 with the desired geometry and properties. It is desirable for the spring insert 140 to be formed of a material with a high elongation. The high elongation allows the spring insert 140 to flex and "bounce back" easily. The high elongation material allows the spring insert 140 to flex and bend in response to forces associate with use of the truck 100.

In many embodiments, the spring insert 140 is configured to engage a portion of the hanger 102. As shown in FIG. 10, the hanger 102 comprises a shoulder 150 on each of the first and second ends, where the central axle 108 is attached. The spring insert 140 is disposed within the level arm 110 in such a way that it is mounted on the shoulder 150 of the hanger 102. The shoulder 150 and the spring insert 140 can comprise complementary geometries that together produce the desired spring effect as force is applied to the level arm 110. The spring insert 140 comprises an internal geometry configured to engage the shoulder 150 and act as a spring. The internal geometry can comprise a plurality of apertures, extensions, flexures, slots, grooves, notches, and/or any other features that are configured to engage the central axle 108 and/or hanger 102 in a way that produces the desired spring effect. In many embodiments, the internal geometry can take the form of a cutout extending through the entire thickness of the spring insert 140 and thereby forms one or more apertures. In many embodiments, the shoulder 150 can be generally cylindrical. In some embodiments, the shoulder 150 comprises one or more notches configured to interact and provide resistance between one or more features of the spring insert geometry.

Figure 11:
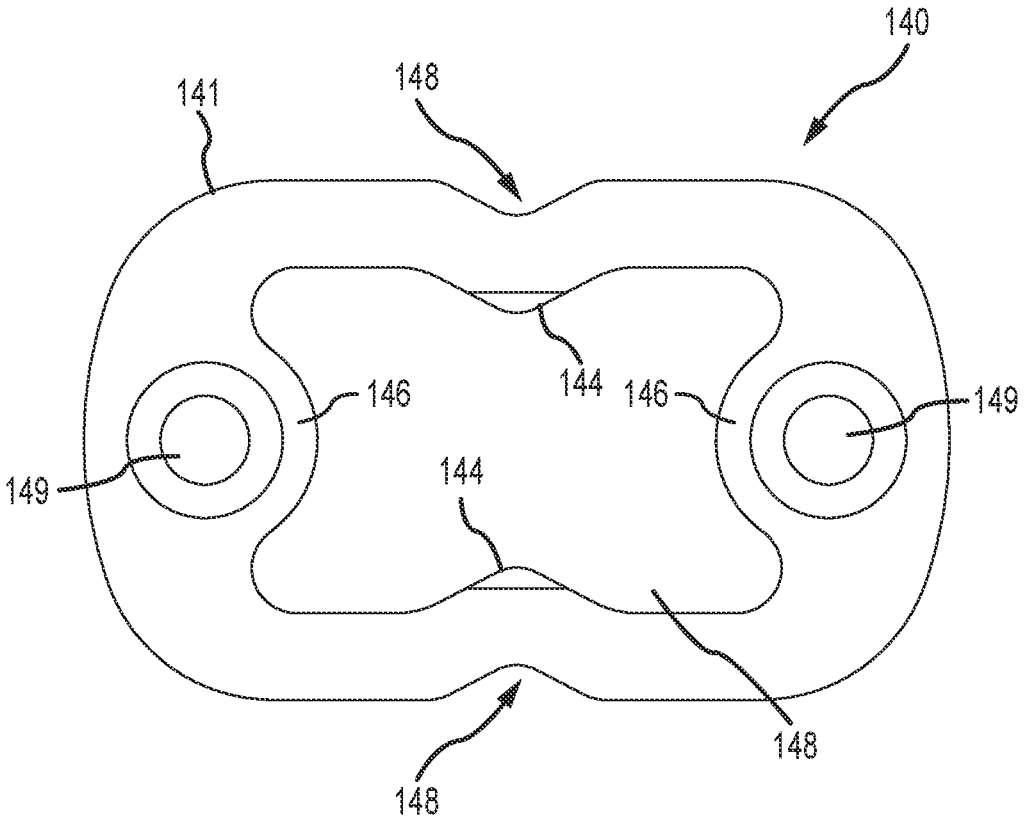
FIG. 11 illustrates a spring insert according to one embodiment of a multi-wheel truck.

In one embodiment, referring to FIG. 11, the spring insert 140 comprises a perimeter 141 forming a central aperture 142 therein, a plurality of protrusions 144, and a plurality of bumper portions 146. The protrusions 144 can extend from the perimeter 141 of the spring insert 140 inward toward the central aperture 142. In many embodiments, the protrusions 144 are configured to fit within corresponding notches 152 formed in the shoulder 150 of the hanger 102. For example, in the illustrated embodiment, the protrusions 144 of the spring insert 140 are generally triangular in shape and are configured to mate with the generally triangular shaped notches 152 formed in the shoulder 150 (as shown in FIG. 10). During use of the truck 100 (either riding or carrying the skateboard), the load on the level arm 110 causes the protrusion 144 to press against the surface of the shoulder 150 and provide resistance against rotation. However, due to the flexibility of the spring insert material, the protrusion 144 will flex to permit rotation of the arm under a sufficient load. In many embodiments, the spring insert 140 comprises a notch 148 formed opposite the protrusion 144. The notch 148 of the spring insert 140 can provide a small space between the perimeter 141 of the spring insert 140 and the insert recess 132, such that the insert is not flush within the recess at the particular location of the notch 148. The space created by the notch 148 provides a greater ability for the protrusion 144 to flex upon engagement with the shoulder 150.

The spring insert 140 further comprises a plurality of bumper portions 146 that act as guides to keep the spring insert 140 centered about the shoulder 150 of the hanger 102 during use of the truck 100, providing stable rotation of the level arm 110. In many embodiments, while the bumper portions 146 abut a portion of the shoulder 150, the contact area between the shoulder 150 and the bumper portions 146 can be minimal in order not to inhibit the rotation of the level arm 110 during regular use of the skateboard. Rather, the protrusions 144 provide the main contact area between the spring insert 140 and the shoulder 150. Under sufficient loads, the protrusions 144 flex to allow the level arm 110 to rotate, and the bumper portions 146 serve to keep the spring insert 140 centered.

The spring insert 140 can further comprise a pair of attachment holes 149 located proximate the perimeter 141. The attachment holes 149 can be configured to receive a mechanical fastener (such as a screw). The attachment holes 149 provide locations for the spring insert 140 to be affixed within the level arm 110 by such mechanical fasteners.

Figure 12:
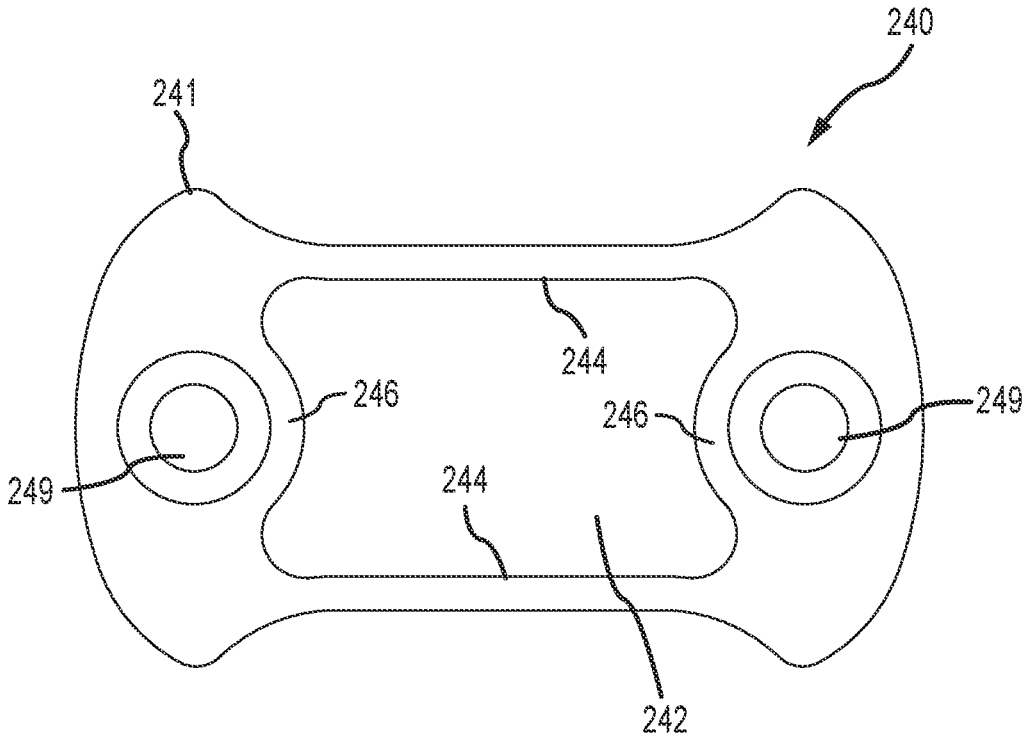
FIG. 12 illustrates a spring insert according to an alternative embodiment of a multi-wheel truck.

FIG. 12 illustrates an alternative embodiment of a spring insert 240 according to the present invention. Spring insert 240 is similar to spring insert 140 and includes substantially the same geometry. Spring insert 240 also performs the same functionality as spring insert 140, wherein upon engagement with the shoulder 150 of the hanger 102, portions of the spring insert geometry are configured to provide resistance against rotation yet flex and allow rotation under sufficient loads. Rather than a protrusion extending inward toward the aperture 242, spring insert 240 comprises a pair of elongate flexure portions 244 extending laterally across the insert. The flexure portion 244 can be substantially thin compared to other portions of the insert, allowing the flexure portion 244 to flex upon engagement with the shoulder 150 of the hanger 102. Similar to the notch 148 of spring insert 140, the flexure portion 244 of spring insert 240 can form a space between the perimeter 241 of the spring insert 240 and the insert recess 132. This space allows the flexure portion 244 to flex outward as the shoulder 150 presses against the flexure portion 244. Under sufficient loads, the flexure portion 244 flexes enough to allow rotation of the level arm 110. In many embodiments, spring insert 240 further comprises a plurality of bumper portions 246 and attachment holes 249 similar to those of spring insert 140.

Figure 13:
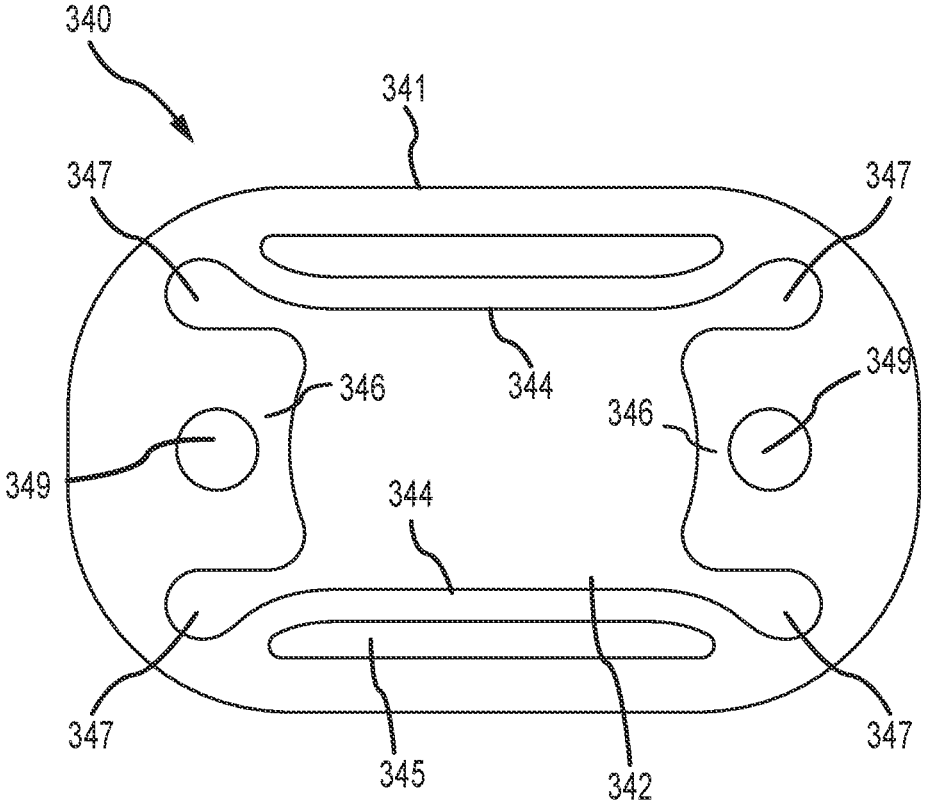
FIG. 13 illustrates a spring insert according to another alternative embodiment of a multi-wheel truck.

FIG. 13 illustrates another alternative embodiment of a spring insert 340 according to the present invention. Spring insert 340 is similar to spring inserts 140 and 240 and includes substantially similar features. Spring insert 340 also performs the same functionality as spring inserts 140 and 240, wherein upon engagement with the shoulder 150 of the hanger 102, portions of the spring insert geometry are configured to provide resistance against rotation, yet flex and allow rotation under sufficient loads. Spring insert 340 comprises a plurality of elongate protrusions 344 that extend away from the perimeter 341 and are configured to engage a portion of the shoulder 150. The spring insert 340 further comprises a slot 345 that separates the elongate protrusion 344 from the perimeter 341. The slot 345 allows the elongate protrusion 344 to flex outward toward the perimeter 341 as the shoulder 150 presses against the elongate protrusion 344. Under sufficient loads, the elongate protrusion 344 flexes enough to allow rotation of the level arm 110. The spring insert 340 further comprises bumper portions 346 similar to the bumper portions 146 of spring insert 140. However, instead of bumper portions 146 that create a small contact area between the bumper portion 346 and the shoulder 150, the bumper portions 346 of spring insert 340 can comprise arcuate surfaces that correspond to the shape of the shoulder 150 and provide a larger contact area between the bumper portion 346 and the shoulder 150. This configuration provides extra stability in centering the spring insert 340 with respect to the central axle 108 and the hanger 102, while still allowing the level arm 110 to rotate. In some embodiments, spring insert 340 further comprises a plurality of gaps 347 formed between each of the bumper portions 346 and elongate protrusions 344. The plurality of gaps 347 can separate the bumper portions 346 and elongate protrusions 344 from one another and allow greater overall flexure within the internal geometry of the spring insert 340.

The spring insert 140 governs the rotation of the level arm 110. When the truck 100 is on the ground, the level arm 110 can be considered at a "rest" position. When at rest, the level arm 110 can be generally parallel to the deck of the skateboard, and the wheels can be spaced approximately evenly away from the underside of the deck. When the skateboard is carried (i.e. when the wheels are not touching the ground), the weight of the wheels applies a force to the level arm 110, causing the level arm 110 to want to rotate away from rest position. The geometry of the spring insert 140 can engage with the geometry of the shoulder 150 and restrict the level arm 110 from rotating, and the level arm 110 will generally be retained in rest position. By retaining the level arm 110 in the rest position and restricting its rotation, the spring mechanism 130 prevents the wheels from slamming into the underside of the deck, as would be the case if the level arm 110 were able to rotate freely as the board is being carried.

During use of the skateboard, however, it is desirable for the level arm 110 to rotate and produce the lifting effect in order to allow the multi-wheel truck 100 to smoothly traverse discontinuous and uneven surfaces. The spring mechanism 130 can permit the level arm 110 to rotate during use of the skateboard. If a sufficient moment is applied to the level arm 110 during use, as would be the case when traversing a crack or uneven surface, the force of the shoulder 150 pressing against the flexible spring insert 140 causes the spring portion to flex, permitting the level arm 110 to rotate and produce the desired lifting effect.

In many embodiments, the spring mechanism 130 can comprise a rotation threshold. The rotation threshold can be defined as the smallest force applied to the level arm 110 wherein the spring mechanism 130 allows the level arm 110 to rotate. For instance, if a force applied to the level arm 110 is less than the rotation threshold, the spring mechanism 130 restricts rotation of the level arm 110 and retains the level arm 110 in the rest position. In contrast, if a force applied to the level arm 110 is greater than the rotation threshold, the spring mechanism 130 permits the level arm 110 to rotate. The rotation threshold can depend on the design of the spring insert 140, specifically the internal geometry and the materials used. Preferably, the spring insert 140 is designed such that the lesser forces associated with the carrying of the skateboard are below the rotation threshold, whereas the greater forces associated with riding a skateboard over obstacles and discontinuous surfaces are preferably above the rotation threshold. In some embodiments, the rotation threshold is approximately between 0.1 ft-lb and 1.5 ft-lb. In some embodiments, the rotation threshold can be approximately between 0.1 ft-lb and 0.25 ft-lb, approximately between 0.25 ft-lb and 0.5 ft-lb, approximately between 0.5 ft-lb and 0.75 ft-lb, approximately between 0.75 ft-lb and 1.0 ft-lb, or approximately between 1.0 ft-lb and 1.5 ft-lb. In some embodiments the rotation threshold can be approximately between 0.1 ft-lb and 0.4 ft-lb, between approximately 0.4 ft-lb and 0.7 ft-lb, between approximately 0.7 ft-lb and 1.1 ft-lb, or between approximately 1.1 ft-lb and 1.5 ft-lb. The rotation threshold allows the spring mechanism 130 to restrict rotation of the level arm 110 under sufficiently small loads yet allow rotation of the level arm 110 under sufficiently large loads.

In many embodiments, the spring mechanism 130 comprises a spring insert 140 located within an insert recess 132 formed from a level arm 110. However, in alternative embodiments, rather than comprising a separate spring insert 140 within the level arm 110, the spring mechanism 130 can be integrally formed within level arm 110. In other words, the level arm 110 can be formed with an integral spring geometry centered about the middle bore 115 that provides the same spring effect as the spring inserts of the above embodiments. In many such embodiments, the level arm 110 comprising an integral spring geometry can be formed of a non-metallic material, such as an injection molded plastic material or a composite material. Embodiments of lift arms with integral spring mechanisms are discussed in further detail below.

IV. Remaining Features

As discussed above, the multi-wheel truck 100 comprises a hanger 102 and a baseplate 170 that serve to couple the plurality of wheel sets and configure the truck 100 to be attachable to the underside of a skateboard deck. As shown in FIG. 2, the hanger 102 is configured to couple the wheel sets to the truck 100, and the baseplate 170 is configured to receive the hanger 102 and attach the truck 100 to the underside of the skateboard deck.

Figure 14:
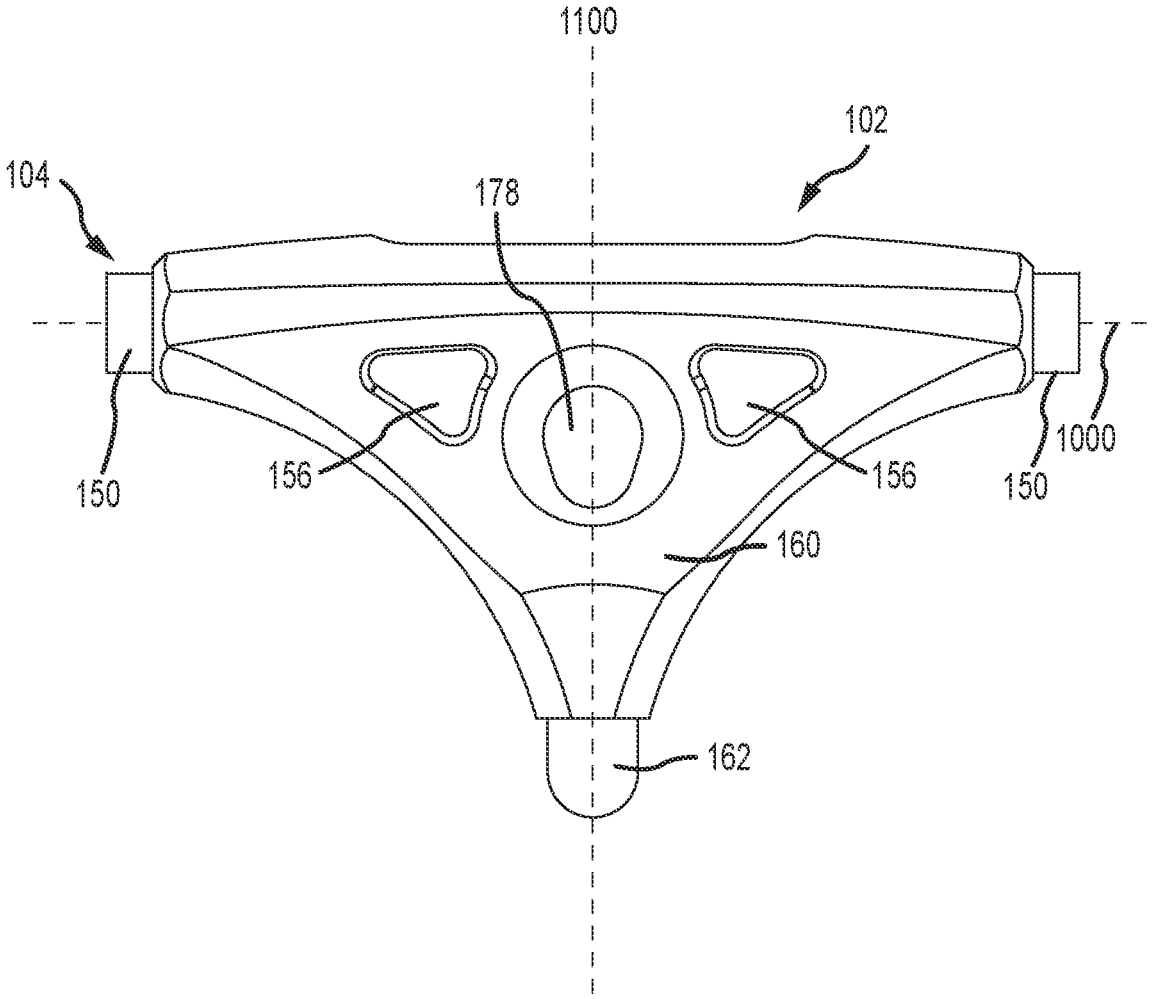
FIG. 14 illustrates a top view a hanger of the truck according to the embodiment of FIG. 1.
Figure 15:
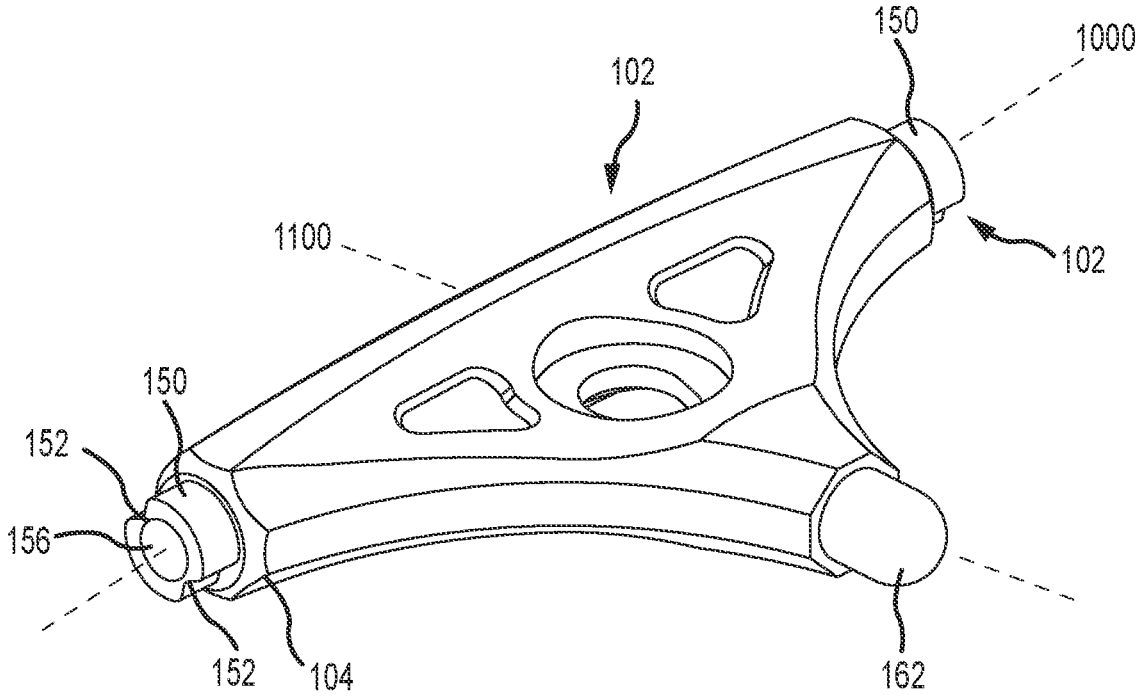
FIG. 15 illustrates a perspective view of the hanger of FIG. 14.

FIGS. 14 and 15 illustrate an embodiment of the hanger 102 of the multi-wheel truck 100. The hanger 102 comprises a first end 104 and a second end 106 opposite the first end 104. The hanger 102 defines a longitudinal axis 1000 extending between the first end 104 and the second end 106, wherein the first and second ends are each located proximate the longitudinal axis 1000. The hanger 102 further defines a transverse axis 1100 that extends perpendicular to the longitudinal axis 1000. As such, the transverse axis 1100 corresponds to a front-to-rear direction of the hanger 102, with respect to the front and the rear of the skateboard. In many embodiments, the first and second ends are located proximate a front of the hanger 102, while other components of the hanger 102, such as a pivot tip 162 or pivot saddle 172, may be located rearward of the first and second ends. In many embodiments, a maximum width of the hanger 102 is located between the first and second ends, such that the front of the hanger 102 comprises the hanger's widest portion. The first and second ends generally form the widest portion of the hanger 102 so that the wheel sets, which are attached to the first and second ends, are spaced away from the remainder of the hanger 102 and are free to rotate without interference from the hanger 102.

Each of the first end 104 and the second end 106 can comprise a void 156 configured to couple the wheel set to the hanger 102. The void 156 is configured to receive the central axle 108 of the wheel set and fixedly attach the central axle 108 to the hanger 102. In many embodiments, the void 156 is threaded to receive a correspondingly threaded portion of the central axle 108. In some embodiments, the void 156 can comprise any form of attachment mechanism suitable for fixedly securing a portion of the central axle 108 therein such as snap fits, adhesives, epoxies, magnets, interlocking attachment mechanisms, or some combination thereof.

As discussed briefly above, the hanger 102 further comprises a plurality of shoulders 150 configured to engage the spring insert 140 of the level arm 110 upon rotation of the level arm 110. As shown in FIGS. 14 and 15, the hanger 102 comprises a shoulder 150 located at each of the first and second end 106. In many embodiments, the shoulder 150 protrudes from the end of the hanger 102 such that it may be received within the internal geometry of the spring insert 140. The shoulder 150 comprises a geometry configured to correspond to the internal geometry of the spring insert 140 in such a way that the shoulder 150 can engage the spring insert 140 upon rotation of the level arm 110 and produce the spring effect discussed above. As illustrated in the embodiment of FIGS. 14 and 15, the geometry comprises a generally cylindrical shape but for a plurality of notches 152 around its perimeter. Each notch 152 can be configured to receive a protrusion 144 of a spring insert 140, such as the protrusions 144 of spring insert 140. As the level arm 110 rotates about the central axle 108, the surface of the notch 152 can press against the protrusion 144 of the spring insert 140 and restrict rotation of the level arm 110 up to a certain amount of force.

In many embodiments, the hanger 102 can be configured to pivot left or right about a portion of the baseplate 170 to control the direction of the skateboard during use. As the rider shifts his or her weight toward either the right or left side of the skateboard, the hanger 102 can pivot about the baseplate 170, turning the skateboard either left or right. The hanger 102 comprises a pivot body 160 configured to engage a pivot cup 164 of the baseplate 170 and allow the hanger 102 to pivot. The pivot body 160 can be located rearward of the front of the hanger 102 and can comprise a width substantially less than the maximum width of the hanger 102. In many embodiments, the pivot body 160 is generally triangularly shaped with rounded edges that allow the hanger 102 to pivot about a surface of the pivot cup 164.

The hanger 102 further comprises a pivot tip 162 configured to center the hanger 102 about the baseplate 170. In many embodiments, the pivot tip 162 protrudes from a rearmost portion of the hanger 102. The pivot tip 162 can be received by a portion of the baseplate 170 such as a pivot cup 164, which will be further detailed below. In many embodiments, the pivot tip 162 is generally cylindrical but for a capped or tipped end that allows the hanger 102 to smoothly rotate and/or pivot within the pivot cup 164. The pivot tip 162 can be integrally formed with the hanger 102, thereby forming a continuous hanger structure.

As illustrated in FIG. 14 The hanger 102 comprises a king pin aperture 178 that receives a king pin 175 or other attachment mechanism to allow the hanger 102 to be coupled to one or more other components of the truck 100, such as a baseplate 170. The king pin aperture 178 can be a through aperture extending through a portion of the hanger body. In many embodiments, the king pin aperture 178 is located substantially in the center of the hanger 102, proximate the pivot body 160. In many embodiments, the king pin aperture 178 is located between the pivot body 160 and the front of the hanger 102. The connection between the hanger 102 and the baseplate 170 via the king pin aperture 178 is further detailed below.

The hanger 102 can be constructed from any material used to construct a conventional skateboard truck. The hanger 102 can be constructed from any one or combination of the following: 8620 alloy steel, S25C steel, carbon steel, maraging steel, 17-4 stainless steel, 1380 stainless steel, 303 stainless steel, stainless steel alloy, brushed steel, tungsten, magnesium, magnesium alloy, titanium, titanium alloy, Ti-6-4, aluminum, aluminum alloy, aluminum 2024, aluminum 3003, aluminum 5052, aluminum 6061, aluminum 7075, ADC-12, aluminum A356, magnesium AZ61A, magnesium AZ80A, magnesium AZ31B, carbon fiber reinforced plastic composite, glass filled plastic composite, nylon, polyether ether ketone, polyetherimide, polyphenylene sulfide or any material suitable for creating a hanger or skateboard truck. In many embodiments, the hanger 102 can be constructed of aluminum 6061, aluminum A356, or magnesium AZ61A. The material of the hanger 102 can vary based upon the intended use and/or desired weight of the hanger 102.

In some embodiments, the hanger 102 can comprise one or more weight saving features 158. The weight saving features 158 can be provided in the form of a notch, an indentation, a gap, a void, or a bore, etc. The weight saving features 158 are zones or portions of the hanger 102 that are devoid of material. The weight saving features 158 can be provided within any portion of the hanger 102, such as the first end 104, the second end 106, the pivot body 160, the pivot tip 162, substantially proximate the front of the hanger 102, or substantially proximate the rear of the hanger 102. In many embodiments, the weight saving features 158 are provided within the pivot body 160, as the pivot body 160 is generally the most substantial portion of the hanger mass.

The weight saving features 158 can occupy between approximately 1% to approximately 20% of the volume of the hanger 102. In many embodiments, the weight saving features 158 can occupy between approximately 1% to approximately 5%, approximately 5% to approximately 10%, approximately 10% to approximately 15%, or approximately 15% to approximately 20% of the volume of the hanger 102. In alternative embodiments, the weight saving features 158 can occupy between approximately 1%, approximately 2%, approximately 3%, approximately 4%, approximately 5%, approximately 6%, approximately 7%, approximately 8%, approximately 9%, approximately 10%, approximately 11%, approximately 12%, approximately 13%, approximately 14%, approximately 15%, approximately 16%, approximately 17%, approximately 18%, approximately 19%, or approximately 20% of the hanger volume. The one or more weight saving features 158 allows the mass of the hanger 102 to be kept to a minimum while maintaining structural integrity.

Figure 16:
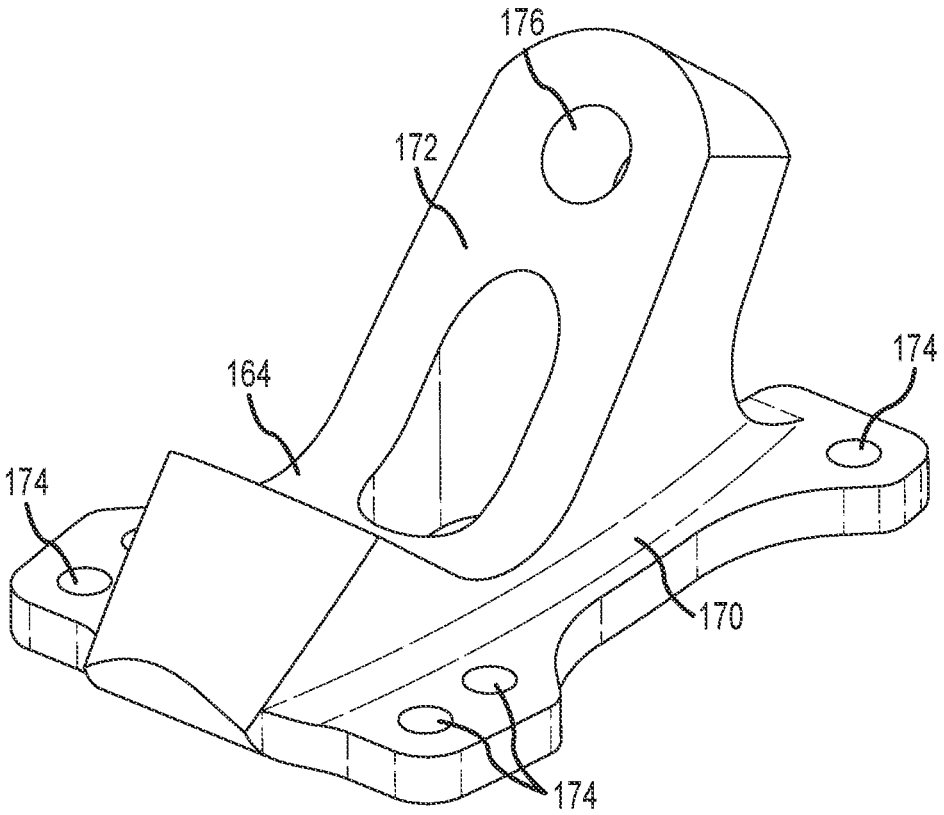
FIG. 16 illustrates a perspective view of a baseplate according of the truck according to the embodiment of FIG. 1.

The truck 100 further comprises a baseplate 170 configured to receive the hanger 102 and couple the truck 100 to the underside of a skateboard deck. The baseplate 170 can be mechanically attached to the underside of the skateboard deck by any fastening means such as screws, bolts, adhesives, snap fits, or some combination thereof. In many embodiments, as illustrated in FIG. 16, the baseplate 170 comprises a plurality of apertures 174 extending through the body of the baseplate 170 and configured to receive a mechanical fastener such as a bolt or screw. In many embodiments, each of the plurality of apertures 174 are proximal to the outer periphery or outer perimeter edge of the baseplate 170. Further, in some embodiments, the apertures 174 can be threaded to receive a corresponding threaded fastener. In some embodiments, the baseplate 170 can have two apertures, three apertures, four apertures, five apertures, six apertures, or seven apertures. In many embodiments, the base plate can comprise at least four apertures 174 to provide sufficient structural rigidity to affix the baseplate 170 to the deck of the skateboard.

The baseplate 170 can be constructed from any material used to construct a conventional skateboard truck. The baseplate 170 can be constructed from any one or combination of the following: 8620 alloy steel, S25C steel, carbon steel, maraging steel, 17-4 stainless steel, 1380 stainless steel, 303 stainless steel, stainless steel alloy, brushed steel, tungsten, magnesium, magnesium alloy, titanium, titanium alloy, Ti-6-4, aluminum, aluminum alloy, aluminum 2024, aluminum 3003, aluminum 5052, aluminum 6061, aluminum 7075, ADC-12, aluminum A356, magnesium AZ61A, magnesium AZ80A, magnesium AZ31B, carbon fiber reinforced plastic composite, glass filled plastic composite, nylon, polyether ether ketone, polyetherimide, polyphenylene sulfide or any material suitable for creating a baseplate or skateboard truck. In many embodiments, the baseplate 170 can be constructed of aluminum 6061, aluminum A356, or magnesium AZ61A. The material of the baseplate 170 can vary based upon the intended use and/or desired weight of the baseplate 170.

The baseplate 170 further comprises a saddle 172 and a pivot cup 164 extending in a direction opposite the skateboard deck. The saddle 172 forms a base for the pivot body 160 of the hanger 102 to sit and pivot upon. In many embodiments, the surface of the saddle 172 is substantially flat. This allows the rounded surface and/or rounded edges of the hanger 102 the ability to pivot about the surface of the saddle 172. The saddle 172 can be located near the front of the baseplate 170 and can orient the hanger 102 in such a way that the front of the hanger 102 is proximate the front of the baseplate 170 when fully assembled. In many embodiments, the saddle 172 extends away from the skateboard deck at an angle so that the hanger 102 is oriented at an angle with respect to the deck of the skateboard. By angling the hanger 102 in such a way, the pivoting action of the hanger 102 upon the saddle 172 causes the wheels to turn either left or right. In this way, the rider can control the direction of the skateboard during use by shifting his or her weight to the left or to the right.

The saddle 172 further comprises a king pin receiving port 176. The king pin receiving port 176 can take the form an aperture extending through the saddle 172. The king pin receiving port 176 is configured to receive a king pin 175 that couples the baseplate 170 to the hanger 102. In many embodiments, the king pin receiving port 176 may or may not be threaded. The geometrical characteristics of the king pin receiving port 176 (i.e. thread type, thread count, pitch, etc.) can vary based upon the type and geometry of the king pin 175.

The pivot cup 164 is formed rearward of the saddle 172 and is configured to receive the pivot tip 162 of the hanger 102. The pivot cup 164 forms a cup-like structure including one or more inner walls forming a cavity. The pivot cup 164 is shaped to receive the pivot tip 162 and house the pivot tip 162 within the cavity. When assembled, the pivot cup 164 helps to center the hanger 102 on the baseplate 170 by retaining the pivot tip 162 within the pivot cup 164. In many embodiments, the inner walls of the pivot cup 164 can form a generally cylindrical shape that corresponds to the generally cylindrical shape of the pivot tip 162. In this way, the pivot tip 162 can be retained within the pivot cup 164, while still being allowed to rotate within the pivot cup 164 as the hanger 102 pivots.

Figure 17:
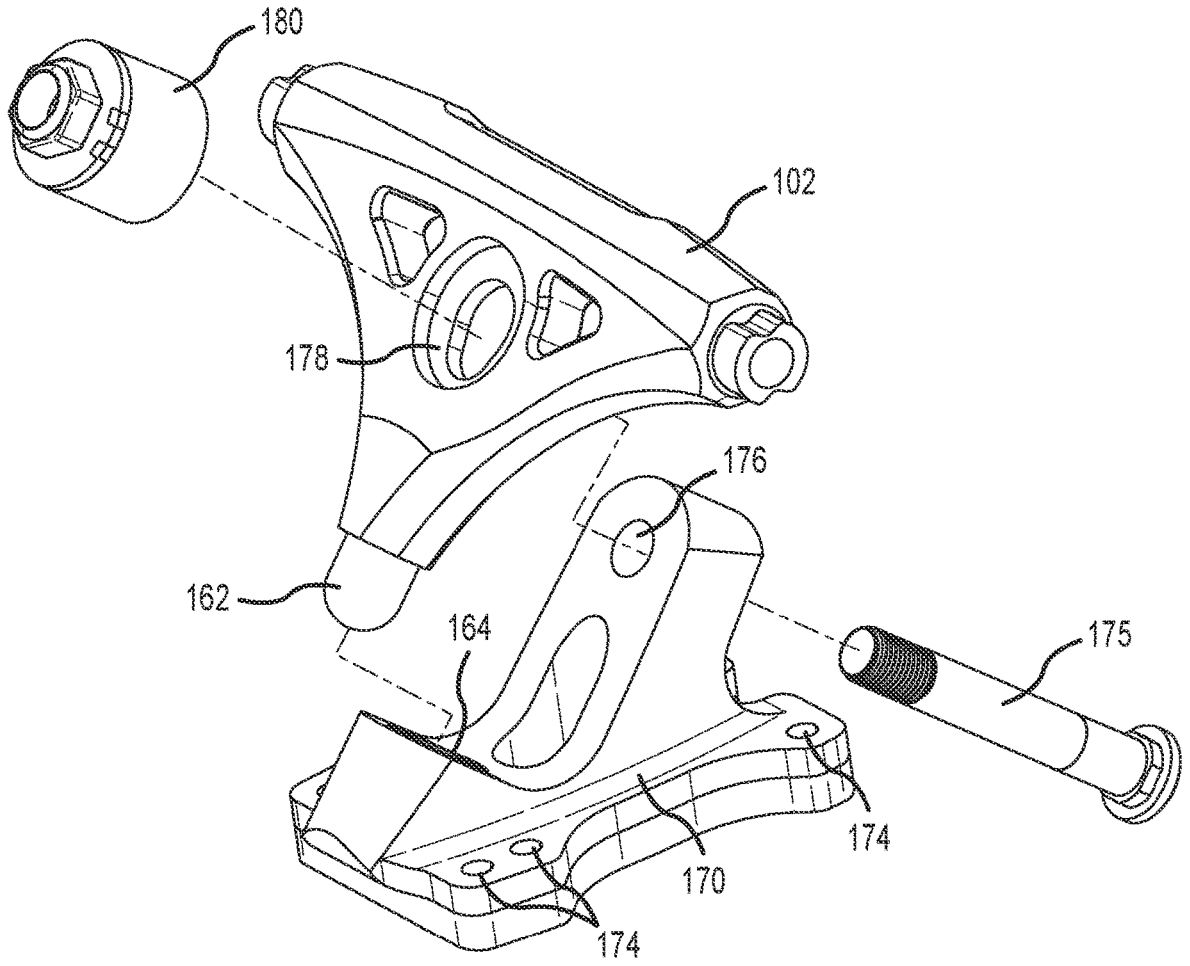
FIG. 17 illustrates an exploded view of a hanger and baseplate assembly of the truck of FIG. 1.

FIG. 17 illustrates the configuration in which the hanger 102 and the baseplate 170 are coupled. The hanger 102 sits upon the baseplate 170 and is coupled thereto by a king pin 175. The hanger 102 sits upon the angled saddle 172, orienting the hanger 102 at an angle with respect to the skateboard deck. The pivot body 160 of the hanger 102 rests upon the surface of the saddle 172 in a way that allows the hanger 102 to pivot about the saddle 172. Further, the pivot tip 162 of hanger 102 is inserted into the pivot cup 164 of the baseplate 170 to center the hanger 102 with respect to the baseplate 170.

The king pin receiving port 176 of the saddle 172 is aligned with the king pin aperture 178 of the hanger 102 and each are configured to receive a king pin 175. In many embodiments, the king pin 175 is a threaded, elongate screw. The king pin 175 extends through each of the king pin receiving port 176 and the king pin aperture 178 to couple the hanger 102 and the base. In many embodiments, a threaded bolt 180 can be attached to a threaded end of the king pin 175 to lock the king pin 175 in place and secure the connection between the baseplate 170 and the hanger 102.

As described above, the multi-wheel truck 100 comprises one or more level arms 110 that serve to connect a plurality of wheels in a wheel set and rotate to provide a lifting effect over obstacles and discontinuous surfaces. In many embodiments, the one or more level arms 110 are constructed of a metallic material, a non-metallic material, or some combination thereof. In many embodiments the one or more level arms 110 can be constructed of any one or combination of the following: 8620 alloy steel, S25C steel, carbon steel, maraging steel, 17-4 stainless steel, 1380 stainless steel, 303 stainless steel, stainless steel alloy, brushed steel, tungsten, magnesium, magnesium alloy, titanium, titanium alloy, Ti-6-4, aluminum, aluminum alloy, aluminum 2024, aluminum 3003, aluminum 5052, aluminum 6061, aluminum 7075, ADC-12, aluminum A356, magnesium AZ61A, magnesium AZ80A, magnesium AZ31B, carbon fiber reinforced plastic composite, glass filled plastic composite, nylon, polyether ether ketone (PEEK), polyetherimide, polyphenylene sulfide or any material suitable for creating components of a skateboard truck. In many embodiments, the one or more level arms 110 can be constructed of aluminum 6061, aluminum A356, or magnesium AZ61A. In other embodiments, the one or more level arms 110 can be constructed of nylon or carbon fiber reinforced nylon. In some embodiments, the one or more level arms 110 can comprise a multi-part construction combining a portion formed of a carbon fiber reinforced plastic and a plastic without carbon fiber reinforcement.

Figure 18:
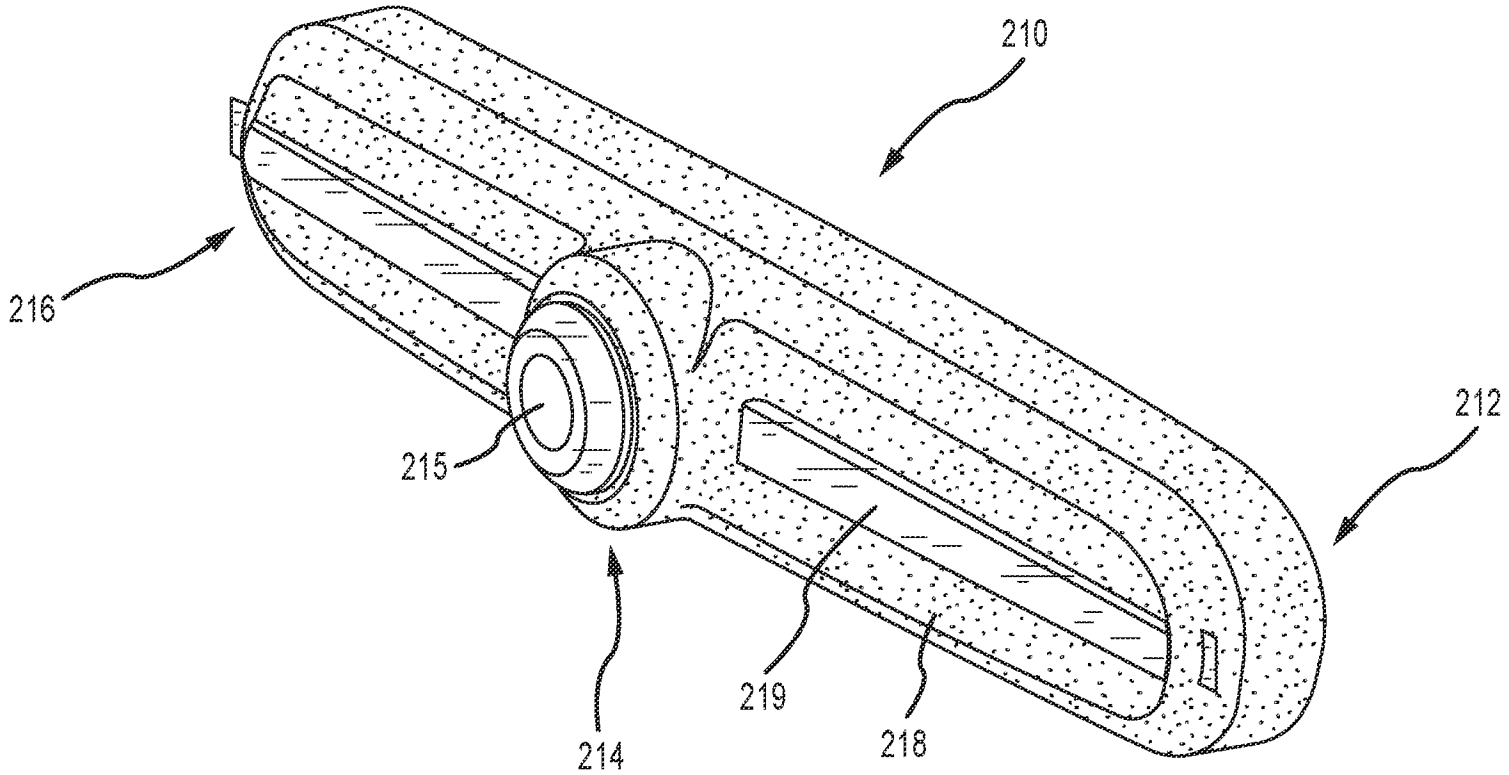
FIG. 18 illustrates a perspective view of a level arm of a multi-wheel truck according to an alternative embodiment.

As illustrated in an alternative embodiment of FIG. 18, the one or more level arms 210 can comprise a multi-part construction comprising a skeletal portion 218 and a casing portion 219. The skeletal portion 218 can be an internal portion of the level arm 210 and can comprise the main structural elements of the level arm, including forming the front, middle, and rear apertures of the level arm 210. In this way, the skeletal portion 218 is the only portion of the level arm that directly receives and contacts the plurality of axles of the wheel set. The skeletal portion 218 can be formed of a high strength material to provide support and durability to the level arm 210. In many embodiments, the skeletal portion 218 can be constructed of a hard plastic such as a carbon fiber reinforced plastic composite material or a glass filled plastic composite material, a metallic material, or any other material possessing sufficient strength to provide support and durability to the level arm 210.

The casing portion 219 surrounds and encases at least a portion of the skeletal portion 218. In many embodiments, the casing portion 219 is constructed of a "softer material" comprising a higher elongation than the skeletal portion 218. In many embodiments, the casing portion 219 is constructed of an injection molded plastic, an unfilled plastic (i.e. a plastic devoid of carbon fiber or glass reinforcement), nylon, polypropylene, polyethylene, or any other plastic or other material with the desired elongation. The casing portion 219 can provide protection against failure of the level arm 210. For example, if the skeletal portion 218, which is rigid due to its high strength, was to become damaged and crack or fail completely, the high elasticity of the casing portion 219 would allow the surrounding casing portion 219 to elongate rather than break. This configuration protects against catastrophic failure of the level arm 210.

The casing portion 219 can also be configured to comprise a spring mechanism 230 integrally formed within. Due to the ability to injection mold the casing portion 219, the casing portion 219 can be designed to comprise a spring geometry substantially similar to the geometry of spring inserts 140, 240, and 340. Including an integrally formed spring mechanism 230 within the level arm 210 itself eliminates the need for a separately formed spring insert.

As discussed above, the multi-wheel truck 100 comprises a plurality of wheels including at least one central wheel 120 and one or more auxiliary wheels. Each wheel may be characterized by a diameter (wheel diameter), a width (wheel width), a durometer (wheel durometer), and a material (wheel material). In many embodiments, the characteristics (diameter, width, durometer, and/or material) of the central wheel 120 can differ from those of one or more of the auxiliary wheels. In other embodiments, the characteristics of the central wheel 120 can be substantially similar to those of one or more of the auxiliary wheels.

In many embodiments, the diameter of one or more wheels, as illustrated in FIG. 6, ranges approximately between 1.5 inches and 4.0 inches. In some embodiments, the diameter of one or more wheels can range between 1.5 inches and 2.0 inches, between 2.0 inches and 2.5 inches, between 2.5 inches and 3.0 inches, between 3.0 inches and 3.5 inches, or between 3.5 inches and 4.0 inches. In some embodiments, the diameter of one or more wheels can range between 1.5 inches and 1.75 inches, between 1.75 inches and 2.0 inches, between 2.0 inches and 2.25 inches, between 2.25 inches and 2.5 inches, between 2.5 inches and 2.75 inches, between 2.75 inches and 3.0 inches, between 3.0 inches and 3.25 inches, between 3.25 inches and 3.5 inches, between 3.5 inches and 3.75 inches, or between 4.0 inches.

One or more wheels can have a substantially similar diameter with respect to another wheel, two or more wheels, three or more wheels, four or more wheels, or five or more wheels. In many embodiments the at least one central wheel 120 can have a substantially similar diameter D1 with respect to one or more auxiliary wheels. In some embodiments, one or more auxiliary wheels can have a substantially similar diameter D2 with respect to one or more other auxiliary wheels. For example, the leading wheel 122 of a particular wheel set can comprise a substantially similar diameter to the trailing wheel 124 of the same wheel set. In other embodiments, one or more auxiliary wheels can have a substantially different diameter D2 with respect to one or more other auxiliary wheels. For example, the leading wheel 122 of a particular wheel set can comprise a substantially greater or substantially lesser diameter than the trailing wheel 124 of the same wheel set.

In alternative embodiments, one or more wheels can have a substantially different diameter with respect to another wheel, two or more wheels, three or more wheels, four or more wheels, or five or more wheels. In many embodiments the at least one central wheel 120 can have a substantially different diameter with respect to one or more auxiliary wheels. In some embodiments, the diameter D1 of at least one central wheel 120 can be less than the diameter D2 of at least one auxiliary wheel. In some embodiments, the diameter D1 of at least one central wheel 120 can be greater than the diameter D2 of at least one auxiliary wheel. In some embodiments, one or more auxiliary wheels can have a substantially different diameter with respect to one or more other auxiliary wheels. For example, the leading wheel 122 of a particular wheel set can comprise a substantially greater or substantially lesser diameter than the trailing wheel 124 of the same wheel set.

The diameter of the one or more wheels is significant in allowing the truck 100 to smoothly traverse obstacles and discontinuous surfaces. The wheels are sized with sufficiently large diameters such that when a given wheel encounters an obstacle, the point along the wheel that contacts the obstacle occurs low enough on the wheel to reduce the force of impact between the wheel and the obstacle. As discussed above, the diameter of the one or more wheels also impacts the attack angle $\alpha$. Reducing or increasing the diameter of the leading and/or central wheel 120 alters the position of reference point R1 and/or reference point R2 in relation to one another. Altering the location of the reference points may change the orientation of reference line A and effect the attack angle $\alpha$ formed between reference line A and reference line B.

For example, in some embodiments, each of the wheels can be provided with substantially small diameters to provide a substantially steep attack angle $\alpha$ (i.e. an attack angle substantially greater than 45 degrees). In other embodiments, each of the wheels can be provided with a substantially large diameter to provide a substantially shallow angle of attack a (i.e. an attack angle substantially greater than 45 degrees). In some embodiments, each of the wheels can be provided with a different diameter in order to optimize the attack angle $\alpha$. In some embodiments the leading wheel 122 can comprise the greatest diameter, the central wheel 120 can comprise a diameter D1 less than the diameter of the leading wheel 122, and the trailing wheel 124 can comprise a diameter less than both the leading wheel 122 and the central wheel 120. Such an embodiment with a large leading wheel 122 diameter can provide an extra advantage in traversing obstacles. The leading wheel 122 is generally the first wheel to encounter such obstacles, and providing a large leading wheel 122 diameter minimizes the impact between the obstacle and the leading wheel 122. As discussed above, the diameter of each respective wheel can be balanced with the width and spacing of each wheel to optimize the attack angle $\alpha$.

In many embodiments, the wheel width for one or more wheels can range between approximately 0.1 inches and 2.5 inches. In some embodiments, the width of one or more wheels can be between approximately 0.1 and 0.5 inches, between 0.5 and 1.0 inches, between 1.0 and 1.5 inches, between 1.5 and 2.0 inches, or between 2.0 and 2.5 inches. In some embodiments, the wheel for one or more wheels can be between approximately 0.1 and 0.25 inches, between 0.25 and 0.5 inches, between 0.5 and 0.75 inches, between 0.75 and 1.0 inches, between 1.0 and 1.25 inches, between 1.25 and 1.5 inches, between 1.5 and 1.75 inches, between 1.75 and 2.0 inches, between 2.0 and 2.25 inches, or between 2.25 and 2.5 inches.

In many embodiments, the width W2 of each auxiliary wheel is substantially the same as the width of the other auxiliary wheels. For example, the trailing wheel 124 and leading wheel 122 in a given wheel set generally comprise the same width W2. In many embodiments, the width W2 of the auxiliary wheels is approximately 0.5 inches. In many embodiments, the width W2 of one or more of the auxiliary wheels can range between approximately 0.1 and 1.5 inches. In some embodiments, the width W2 of one or more auxiliary wheels can range between approximately 0.1 and 0.3 inches, between 0.3 and 0.5 inches, between 0.5 and 0.7 inches, between 0.7 and 0.9 inches, between 0.9 and 1.1 inches, between 1.1 and 1.3 inches, and between 1.3 and 1.5 inches.

In many embodiments, the width W1 of the central wheel 120 is greater than the width W2 of the auxiliary wheels. In many embodiments, the width W1 of the central wheel 120 is approximately 1.7 inches. In many embodiments, the width W1 of the central wheel 120 can range between approximately 1.0 and 2.5 inches. In some embodiments, the width W1 of the central wheel 120 can be between 1.0 and 1.25 inches, between 1.25 and 1.5 inches, between 1.5 and 1.75 inches, between 1.75 and 2.0 inches, between 2.0 and 2.25 inches, or between 2.25 and 2.5 inches. The central wheel 120, which generally bears the majority of the load when the skateboard is rolling along a smooth rolling surface, is provided with a greater width W1 to provide increased stability to the truck 100 as well as to increase the durability of the central wheel 120.

The respective widths of the wheels, particularly the widths of the central and leading wheels 122, impact the attack angle α. Reducing or increasing the width of the leading and/or central wheel 120 alters the position of reference point R1 and/or reference point R2 in relation to one another. Altering the location of the reference points may change the orientation of reference line A and affect the attack angle α formed between reference line A and reference line B.

In many embodiments, the wheel durometer for each wheel can be determined by the intended use of the wheel and desired gripping ability with the ground surface. For example, if the user requires wheels that provides enough grip to maneuver over uneven or continuous surfaces, sidewalk contraction joints, cracks, pebbles, rocks, etc., then the durometer of one or more wheels measured on a Shore A durometer scale can range between approximately 78 A-98 A. In other embodiments, the durometer of one or more wheels can be between approximately 78 A-80 A, 80 A-82 A, 82 A-84 A, 84 A-86 A, 86 A-88 A, 88 A-90 A, 90 A-92 A, 92 A-94 A, 94 A-96 A, or 96 A-98 A. In some embodiments, the wheel durometer value can be 78 A, 79 A, 80 A, 81 A, 82 A, 83 A, 84 A, 85 A, 86 A, 87 A, 88 A, 89 A, 90 A, 91 A, 92 A, 93 A, 94 A, 95 A, 96 A, 97 A, or 98 A. To achieve a desired wheel durometer, the plurality of wheels can be comprised of various plastic or plastic polyurethane materials of differing hardness values.

In many embodiments, one or more wheels can be constructed of a material selected from the group comprising: Thermoplastic resins, thermoplastic polyurethane, thermosetting resins, aromatic diisocyanates, toluene diisocyanate (TDI), methylenediphenyl diisocyanate (MDI), nylon, polypropylene, polyethylene, or any material suitable for creating a skateboard wheel. In some embodiments, the material of the central wheel 120 is the same as the material of the plurality of auxiliary wheels 122, 124. In other embodiments, the central wheel 120 can be constructed of a first material selected from the above group while the plurality of auxiliary wheels 122, 124 are constructed of a second material selected from the above group. In many embodiments, the central wheel 120 is constructed of a thermosetting plastic such as MDI and the plurality of auxiliary wheels 122, 124 are constructed of TPU.

V. Electric Skateboard Embodiment

In some embodiments (not shown), the multi-wheel truck 100 described herein can be configured to be applied to an electric skateboard. In many embodiments, the multi-wheel truck 100 can be configured to receive one or more belts connected to an electric motor. In such embodiments, the belt can connect the electric motor to the central axle 108, wherein the motor is configured to drive the central axle 108 via the one or more belts. The electric motor can deliver power to the axle by driving the belt, which in turn spins the axle. In such embodiments, the central wheel 120 of each wheel set can be fixedly attached to the central axle 108 rather than rotatably attached. This way, the central wheels 120 can spin when powered by the electric motor and propel the skateboard forward.

In other embodiments (not shown), the multi-wheel truck 100 can comprise one or more wheels configured to receive a hub motor. Each hub motor can be caged inside each of the central wheels 120 and can couple to the central axle 108. In such embodiments, the hub motor can rotate about the central axle 108, providing power to the central wheel 120 and causing the central wheel 120 to spin. The spinning of the central wheel 120 by the hub motor propels the skateboard forward.

In some embodiments, the multi-wheel truck 100 can be configured to receive one or more sensors in one of the wheels, one or more of the axles, the hanger 102, or the pivot saddle 172. The sensors can be in communication with the motor and transmit a signal that controls the speed of the motor when the user steps on to the board or shifts weight. In this way, the user can control the speed of the skateboard by leaning forward or backwards on the deck of the skateboard.

VI. Examples

1. Example 1

An exemplary skateboard truck 100 according to the present invention comprises a wheel set configuration that creates an attack angle α of 43.72 degrees. The exemplary truck 100 comprises a front-to-rear distance 142 between the leading wheel 122 and the central wheel 120 of 1.62 inches. The exemplary truck 100 comprises a lateral distance P1 between the first plane 2000 upon which the central wheel 120 sits and the second plane 3000 upon which the leading wheel 122 sits of 1.97 inches. The leading wheel 122 comprises a width W2 of 0.55 inches and a diameter D2 of 2.75 inches. The central wheel 120 comprises a width W1 of 1.68 inches and a diameter D1 of 2.76 inches. The respective size and location of the leading wheel 122 and the central wheel 120 of the exemplary truck 100 positions the first reference point R1 and the second reference point R2 in such a way that the line A connecting the first reference point R1 and the second reference point R2 forms an attack angle α of 43.72 degrees with respect to the reference line B extending parallel to the longitudinal axis.

2. Example 2

The deceleration over a 1.5-inch bump of the exemplary skateboard of Example 1 comprising multi-wheel trucks (6 wheels total per truck) with level arms comprising a spring mechanism 130 and an attack angle α of 43.72 degrees according to the present invention was compared to a control skateboard comprising conventional trucks (2 wheels total per truck) devoid of any level arms. The deceleration of the skateboard experienced during impact with the bump was measured by an accelerometer during each trial. Table 1 below displays the results of the comparison. Higher magnitudes correspond to greater deceleration and a greater loss of speed.

TABLE 1

| Skateboard | Trial 1 Deceleration (G) | Trial 2 Deceleration (G) | Trial 3 Deceleration (G) | Average Deceleration (G) |
|---|---|---|---|---|
| 2 wheel | 5.38 | 3.98 | 2.49 | 3.95 |
| 6 wheel | 1.93 | 1.41 | N/A | 1.67 |

On average, the exemplary skateboard deceleration 2.28 G less than the control skateboard. This decrease in deceleration on the exemplary skateboard translates to a loss of speed over the bump that is 58% less than the control skateboard.

The deceleration over a 3-inch expansion joint (or crack) of the exemplary skateboard of Example 1 comprising multi-wheel trucks (6 wheels total per truck) with level arms comprising a spring mechanism 130 and an attack angle α of 43.72 degrees according to the present invention was compared to a control skateboard comprising conventional trucks (2 wheels total per truck) devoid of any level arms. The deceleration of the skateboard experienced during impact with the expansion joint was measured by an accelerometer during each trial. Table 2 below displays the results of the comparison. Higher magnitudes correspond to greater deceleration and a greater loss of speed.

TABLE 2

| Skateboard | Trial 1 Deceleration (G) | Trial 2 Deceleration (G) | Trial 3 Deceleration (G) | Average Deceleration (G) |
|---|---|---|---|---|
| 2 wheel | 3.63 | 3.28 | 2.66 | 3.19 |
| 6 wheel | 0.89 | 1.2 | 1.12 | 1.07 |

On average, the exemplary skateboard experienced a deceleration of 2.12 G less than the control skateboard. This reduced deceleration of the exemplary skateboard translates to a loss of speed over the crack that is 66% less than the control skateboard.

The retention of speed experienced by the exemplary skateboard over bumps and expansion joints as displayed above provides a significantly smoother ride for users of the multi-wheel truck skateboards when compared to skateboards with conventional trucks. Further, the retention of speed over obstacles allows the user to exert less energy to travel the same distance when compared to a conventional skateboard.

3. Example 3

The deceleration over a 1 inch bump at a plurality of different approach angles for the exemplary skateboard of Example 1 comprising multi-wheel trucks (6 wheels total per truck) with level arms 110 comprising a spring mechanism 130 and an attack angle α of 43.72 degrees according to the present invention was compared to a control skateboard comprising conventional trucks (2 wheels total per truck) devoid of any level arms. During each trial, a user riding the skateboard approached the 1 inch bump at a speed of 5.5 miles per hour. The deceleration experienced during impact with the bump for each trial was measured an accelerometer mounted to the skateboard. Table 3 below displays the results of the comparison.

TABLE 3

| Approach Angle (Degrees) | Skateboard | Trial 1 Deceleration (G) | Trial 2 Deceleration (G) | Trial 3 Deceleration (G) | Average Deceleration (G) |
|---|---|---|---|---|---|
| 90 | 2 wheel | 5.17 | 3.04 | 3.86 | 4.02 |
| 90 | 6 wheel | 2.36 | 3.21 | 2.29 | 2.62 |
| 75 | 2 wheel | 4.72 | 3.64 | 4.79 | 4.38 |
| 75 | 6 wheel | 3.31 | 3.64 | 4.11 | 3.69 |
| 60 | 2 wheel | 4.84 | 4.98 | 3.45 | 4.42 |
| 60 | 6 wheel | 3.35 | 3.58 | 4.59 | 3.84 |
| 45 | 2 wheel | 3.26 | 3.86 | 3.27 | 3.47 |
| 45 | 6 wheel | 2.36 | 3.43 | 3.82 | 3.20 |

For impacts occurring at an approach angle of 90 degrees (substantially perpendicular), the exemplary skateboard, on average, experienced a deceleration of 1.40 G less than the control skateboard. This reduced deceleration on the exemplary skateboard translates to a loss of speed over the bump that is 42% less than the control skateboard. For impacts occurring at an approach angle of 75 degrees (15 degrees from perpendicular), the exemplary skateboard, on average, experienced a deceleration of 0.69 G less than the control skateboard. This decrease in deceleration on the exemplary skateboard translates to a loss of momentum over the bump that is 17% less than the control skateboard. For impacts occurring at an approach angle of 60 degrees (30 degrees from perpendicular), the exemplary skateboard, on average, experienced a deceleration of 0.58 G less than the control skateboard. This decrease in deceleration on the exemplary skateboard translates to a loss of momentum over the bump that is 14% less than the control skateboard. For impacts occurring at an approach angle of 45 degrees (45 degrees from perpendicular), the exemplary skateboard, on average, experienced a deceleration of 0.27 G less than the control skateboard. This decrease in deceleration on the exemplary skateboard translates to a loss of momentum over the bump that is 8% less than the control skateboard.

The most significant speed retention effect of the exemplary skateboard when compared to the control skateboard occurred on impacts closest to a perpendicular approach angle. This is due to the suspension system directly providing the lifting effect over the bump. The exemplary skateboard experienced the least amount of deceleration when approaching the bump straight on, while the control skateboard experienced a significant amount of deceleration when approaching the bump straight on. The user of the exemplary skateboard can take on obstacles straight on and successfully traverse them without a significant loss of speed. This enables the user of the exemplary skateboard to take a more direct route of travel during normal use of the skateboard, cutting down on time and distance of travel.

The exemplary skateboard further exhibited reduced deceleration for non-perpendicular angles. Even at approach angles as shallow as 45 degrees, which are non-typical during use of a skateboard, the exemplary skateboard exhibited a significant retention of speed as compared to the control skateboard. It can be seen that the attack angle $\alpha$ of the exemplary skateboard provides stability and allows the lifting effect to occur even at extreme angles.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A truck comprising:

a hanger comprising a first end and a second end spaced from the first end and a longitudinal axis extending from the first end to the second end;

a wheel assembly located near one of the first end and the second end of the hanger and coupled to the hanger by a central axle, the wheel assembly comprising:

a central wheel and a level arm each coupled to the central axle;

wherein the level arm is configured to rotate about the central axle and comprises a front aperture, a middle aperture, and a rear aperture;

a front axle received by the front aperture of the level arm;

a rear axle received by the rear aperture of the level arm;

a plurality of auxiliary wheels comprising:

a leading wheel affixed to the front axle;

a trailing wheel affixed to the rear axle;

a shoulder wherein the shoulder further comprises a plurality of notches;

an attack angle defined between a first reference line tangent to a forwardmost and outermost point of the leading wheel and a forwardmost and outermost point of the central wheel and a second reference line perpendicular to the longitudinal axis;

wherein the wheel assembly further comprises a spring mechanism configured to limit rotation of the level arm about the central axle; wherein the spring mechanism comprises a spring insert received within a spring recess of the level arm; and wherein the spring mechanism comprises a substantially flat geometry that corresponds to the shape of the spring recess.

2. The truck of claim 1, wherein the spring insert further comprises a perimeter, a central aperture therein a plurality of protrusions and a plurality of bumper portions.

3. The truck of claim 2, wherein the plurality of protrusions extend from the perimeter of the spring insert inward toward the central aperture.

4. The truck of claim 3, wherein the plurality of protrusions are configured to fit within the plurality of notches.

5. The truck of claim 4, wherein the spring insert further comprises a notch.

6. The truck of claim 5, wherein a front-to-rear distance between the front axle and the central axle is approximately between 1.5 inches and 2.0 inches.

7. The truck of claim 3, wherein the plurality of protrusions are generally triangular in shape and the plurality of notches are generally triangular in shape, and the plurality of protrusions are configured to mate with the plurality of notches.

8. The truck of claim 6, wherein the spring insert further comprises a notch.

9. The truck of claim 6, wherein a front-to-rear distance between the front axle and the central axle is approximately between 1.5 inches and 2.0 inches.

10. The truck of claim 6, wherein a front-to-rear distance between the central axle and the rear axle is approximately between 1.5 inches and 2.0 inches.

11. A truck comprising:

a hanger, a pivot saddle, a baseplate, and a plurality of wheels;

wherein the hanger comprises:

a first end and a second end spaced from the first end;

a longitudinal axis extending between the first and second end;

a first central axle coupled to the first end and a second central axle coupled to the second end;

wherein the first central axle comprises a first shoulder wherein the first shoulder further comprises a first plurality of notches;

wherein the second central axle comprises a second shoulder wherein the second shoulder further comprises a second plurality of notches;

wherein the first central axle and the second central axle extend along the longitudinal axis;

a first central wheel coupled to the first central axle;

a second central wheel coupled to the second central axle;

an assembly; the assembly comprising:

a first level arm coupled to the first central axle and a second level arm coupled to the second central axle;

wherein the first level arm is configured to couple a first leading wheel and a first trailing wheel;

wherein the second level arm is configured to couple a second leading wheel and a second trailing wheel;

wherein the first level arm is configured to rotate about the first central axle;

wherein the second level arm is configured to rotate about the second central axle;

wherein the truck further comprises an attack angle defined as an angle between a first reference line and a second reference line;

wherein the first reference line is tangent to a forwardmost and outermost point of the first leading wheel and a forwardmost and outermost point of the first central wheel; and wherein the second reference line is parallel to the longitudinal axis;

wherein the truck further comprises a first spring mechanism and a second spring mechanism configured to limit rotation of the first level arm and the second level arm about the first central axle and the second central axle;

wherein the first spring mechanism and the second spring mechanism comprises a first spring insert and a second spring insert received within a first spring recess of the first level arm and a second spring recess of the second level arm; and wherein the first spring mechanism and the second spring mechanism comprise a substantially flat geometry that corresponds to the shape of the first spring recess and the second spring recess.

12. The truck of claim 11, wherein the spring insert further comprises a perimeter, a central aperture therein a plurality of protrusions and a plurality of bumper portions.

13. The truck of claim 12, wherein the plurality of protrusions extend from the perimeter of the spring insert inward toward the central aperture.

14. The truck of claim 13, wherein the plurality of protrusions are configured to fit within the plurality of notches.

15. The truck of claim 14, wherein the spring insert further comprises a notch.

16. The truck of claim 13, wherein the plurality of protrusions are generally triangular in shape and the plurality of notches are generally triangular in shape, and the plurality of protrusions are configured to mate with the plurality of notches.

17. The truck of claim 16, wherein the spring insert further comprises a notch.

18. The truck of claim 14, wherein the first leading wheel and first trailing wheel are located on a first plane, wherein the first plane is perpendicular to the longitudinal axis; and wherein the first central wheel is located on a second plane, wherein the second plane is parallel to first plane.

19. The truck of claim 18, wherein the first plane is offset from the second plane in a longitudinal direction by a distance approximately between 1.5 and 2.0 inches; and wherein the second plane is located further from the first end of the hanger than the first plane.

* * * * *